US010611164B2

(12) United States Patent
Nukui

(10) Patent No.: US 10,611,164 B2
(45) Date of Patent: Apr. 7, 2020

(54) LIQUID CARTRIDGE INCLUDING COMMUNICATION PASSAGE AND SEALING MEMBER FITTED THERETO

(71) Applicant: BROTHER KOGYO KABUSHIKI KAISHA, Nagoya-shi, Aichi-ken (JP)

(72) Inventor: Kosuke Nukui, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/118,763

(22) Filed: Aug. 31, 2018

(65) Prior Publication Data

US 2019/0299638 A1 Oct. 3, 2019

(30) Foreign Application Priority Data

Mar. 29, 2018 (JP) ..... 2018-064178

(51) Int. Cl.
*B41J 2/175* (2006.01)

(52) U.S. Cl.
CPC ..... *B41J 2/17553* (2013.01); *B41J 2/1753* (2013.01); *B41J 2/17513* (2013.01); *B41J 2/17523* (2013.01); *B41J 2/17566* (2013.01)

(58) Field of Classification Search
CPC ..... B41J 2/17553; B41J 2/17513; B41J 2/17523; B41J 2/1753; B41J 2/1752; B41J 2/17546
USPC ..... 347/85–87
See application file for complete search history.

(56) References Cited

U.S. PATENT DOCUMENTS

| | | | |
|---|---|---|---|
| 5,606,988 | A | 3/1997 | Pawlowski, Jr. |
| 9,315,034 | B2 | 4/2016 | Ono et al. |
| 2017/0246873 | A1 | 8/2017 | Arimura et al. |
| 2018/0244061 | A1 | 8/2018 | Hayashi et al. |

FOREIGN PATENT DOCUMENTS

| | | |
|---|---|---|
| EP | 3 210 785 A1 | 8/2017 |
| JP | 2006-95817 A | 4/2006 |

OTHER PUBLICATIONS

Extended European Search Report issued in related European Patent Application No. 18192065.3, dated Feb. 22, 2019.

*Primary Examiner* — An H Do
(74) *Attorney, Agent, or Firm* — Merchant & Gould P.C.

(57) ABSTRACT

There is provided a liquid cartridge attachable to an attachment portion. The attachment portion includes: a holder providing an accommodation space; a tube formed with an opening; a valve movable between an open position opening the opening and a closed position closing the opening; a protrusion protruding from the valve toward the accommodation space; and a spring urging the valve toward the closed position. The liquid cartridge includes: a liquid chamber; a communication passage extending from the liquid chamber in a first direction to have an open end; a sealing member fitted to the communication passage; and a surface positioned closer to the liquid chamber than the sealing member to the liquid chamber in the first direction. In an attached state, the tube extends through the open end and sealing member, the opening is positioned in the communication passage, and the surface is in contact with the protrusion and tube.

14 Claims, 14 Drawing Sheets

LIQUID CARTRIDGE INCLUDING COMMUNICATION PASSAGE AND SEALING MEMBER FITTED THERETO

CROSS REFERENCE TO RELATED APPLICATION

This application claims priority from Japanese Patent Application No. 2018-064178 filed Mar. 29, 2018. The entire content of the priority application is incorporated herein by reference.

TECHNICAL FIELD

The present disclosure relates to a liquid cartridge storing liquid therein, and a system including the liquid cartridge and an attachment portion to which the liquid cartridge is attachable.

BACKGROUND

One conventional system known in the art includes an ink cartridge, and an inkjet recording device. The inkjet recording device includes an attachment portion. The ink cartridge can be attached to and detached from the attachment portion.

One such inkjet recording device has an inkjet head, and a hollow supply needle that is inserted into the ink cartridge when the ink cartridge is attached to the attachment portion. Ink stored in the ink cartridge is supplied to the inkjet head through the supply needle. A valve and spring may be provided in the supply needle for preventing ink from leaking out of an interior of the supply needle (see Japanese Patent Application Publication No. 2006-95817, for example). The spring urges the valve toward a closed position in which the valve closes an opening formed in the supply needle. When the ink cartridge is attached to the attachment portion, the valve is moved against the urging force of the spring to an open position and is maintained in this open position. A valve and spring may also be provided in the ink cartridge for preventing ink from leaking out of the cartridge. Through contact with parts of the attachment portion, the ink cartridge is maintained at a prescribed position in the attachment portion against the urging force of the spring. In a state in which the ink cartridge is maintained in this prescribed position in the attachment portion, each of the valves is also maintained in its open position. The ink cartridge may further be provided with an IC board or the like that stores information related to the ink cartridge, such as information on the residual quantity of ink in the ink cartridge.

SUMMARY

In a case where a valve and spring are provided in each of the supply needle of the inkjet recording device and the ink cartridge, each of the urging forces of the springs is applied to parts of the ink cartridge that are in contact with the attachment portion when the ink cartridge is retained in the prescribed position in the attachment portion.

With the conventional structure, parts of the ink cartridge could become deformed if the ink cartridge is continuously maintained at the prescribed position in the attachment portion for a long period of time. If parts of the ink cartridge are deformed, the ink cartridge could shift from its prescribed position or change its orientation within the attachment portion. Such changes in position or orientation could adversely affect connections between the ink cartridge and attachment portion, such as electrical connections between the attachment portion and the IC board.

In view of the foregoing, it is an object of the present disclosure to provide a liquid cartridge capable of preventing a large load from being applied to the liquid cartridge while the liquid cartridge is retained at a prescribed position in the attachment portion. It is another object of the present disclosure to provide a system equipped with this liquid cartridge.

In order to attain the above and other objects, according to one aspect, the present disclosure provides a liquid cartridge attachable to an attachment portion. The attachment portion includes a holder, a tube, a valve, a protrusion and a spring. The holder provides an accommodation space for accommodating therein the liquid cartridge in an attached state. The tube is formed with an opening opening toward the accommodation space. The valve is movable between an open position opening the opening and a closed position closing the opening. The protrusion protrudes from the valve toward the accommodation space. In the closed position of the valve, the protrusion protrudes into the accommodation space through the opening. The spring urges the valve toward the closed position. The liquid cartridge includes: a liquid chamber for storing therein liquid; a communication passage for communicating the liquid chamber with an outside of the liquid cartridge; a sealing member; and a surface. The communication passage extends from the liquid chamber in a first direction to have an open end in the first direction. The sealing member is fitted to the communication passage. The surface faces the sealing member in the first direction and is spaced away from the sealing member in the first direction. The surface being positioned closer to the liquid chamber in the first direction than the sealing member is to the liquid chamber in the first direction. In the attached state, the tube extends through the open end and the sealing member, the opening is positioned in the communication passage, and the surface is in contact with both the protrusion and the tube.

According to another aspect, the present disclosure also provides a liquid cartridge attachable to an attachment portion. The attachment portion includes a holder, a tube, a valve, a protrusion and a spring. The holder provides an accommodation space for accommodating therein the liquid cartridge in an attached state. The tube is formed with an opening opening toward the accommodation space. The valve is movable between an open position opening the opening and a closed position closing the opening. The protrusion protrudes from the valve toward the accommodation space. In the closed position of the valve, the protrusion protrudes into the accommodation space through the opening. The spring urges the valve toward the closed position. The liquid cartridge includes; a liquid chamber for storing therein liquid; a communication passage for communicating the liquid chamber with an outside of the liquid cartridge; a sealing member; a first surface; and a second surface. The communication passage extends from the liquid chamber in a first direction to have an open end in the first direction. The sealing member is fitted to the communication passage. The first surface faces the sealing member in the first direction and is spaced away from the sealing member in the first direction. The first surface is positioned closer to the liquid chamber in the first direction than the sealing member is to the liquid chamber in the first direction. The second surface faces the sealing member in the first direction and is spaced away from the sealing member in the first direction. The second surface is positioned closer to the liquid chamber in the first direction than the sealing member is to the liquid chamber in the first direction. In the attached state, the tube extends through the open end and the sealing member, the opening is positioned in the communication passage, the first surface is in contact with the protrusion, and the second surface is in contact with the tube.

According to still another aspect, the present disclosure also provides a system including an attachment portion and an liquid cartridge attachable to the attachment portion. The attachment portion includes a holder, a tube, a valve, a protrusion and a spring. The holder provides an accommodation space for accommodating therein the liquid cartridge in an attached state. The tube is formed with an opening opening toward the accommodation space. The valve is movable between an open position opening the opening and a closed position closing the opening. The protrusion protrudes from the valve toward the accommodation space. In the closed position of the valve, the protrusion of the attachment portion protrudes into the accommodation space through the opening. The spring urges the valve toward the closed position. The liquid cartridge includes: a liquid chamber for storing therein liquid; a communication passage for communicating the liquid chamber with an outside of the liquid cartridge; a sealing member; and a surface facing. The communication passage extends from the liquid chamber in a first direction to have an open end in the first direction. The sealing member is fitted to the communication passage. The surface faces the sealing member in the first direction and is spaced away from the sealing member in the first direction. The surface is positioned closer to the liquid chamber in the first direction than the sealing member is to the liquid chamber in the first direction. In the attached state, the tube extends through the open end and the sealing member, the opening is positioned in the communication passage, and the surface is in contact with both the protrusion and the tube.

BRIEF DESCRIPTION OF THE DRAWINGS

The particular features and advantages of the disclosure will become apparent from the following description taken in connection with the accompanying drawings, in which.

DETAILED DESCRIPTION

Figure 1A:
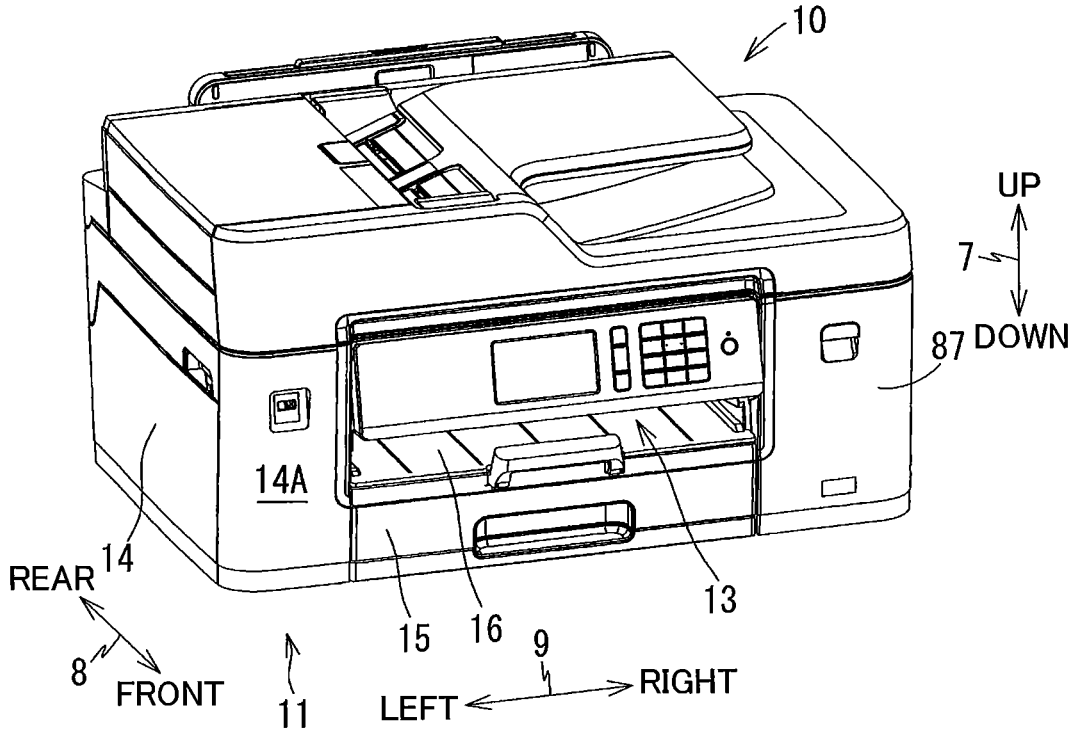
FIG. 1A is a perspective view of a multifunction peripheral according to an embodiment of the present disclosure, the view illustrating an external appearance of the multifunction peripheral in a state in which a cover of the multifunction peripheral is in a closed position.

Next, an embodiment of the present disclosure will be described while referring to the accompanying drawings. Note that it would be apparent to those skilled in the art that the embodiment described below is merely an example of the present disclosure and modifications and variations may be made to the embodiment.

In the following description, an up-down direction 7 is defined based on the orientation of a multifunction peripheral 10 (hereinafter, simply referred to as "MFP 10") when the MFP 10 is resting on a level surface and is ready to use (the orientation shown in FIG. 1; hereinafter called its "operable posture"); a front-rear direction 8 is defined so that the side of the MPF 10 in which an opening 13 is formed constitutes the front side; and a left-right direction 9 is defined based on the perspective of an observer facing the front side of the MFP 10. In the present embodiment, the up-down direction 7 when the MFP 10 is in its operable posture corresponds to the gravitational direction; each of the front-rear direction 8 and left-right direction 9 corresponds to the horizontal direction; the front-rear direction 8 and the left-right direction 9 are orthogonal to each other; and the front-rear direction 8 and the left-right direction 9 are orthogonal to the gravitational direction.

Figure 7:
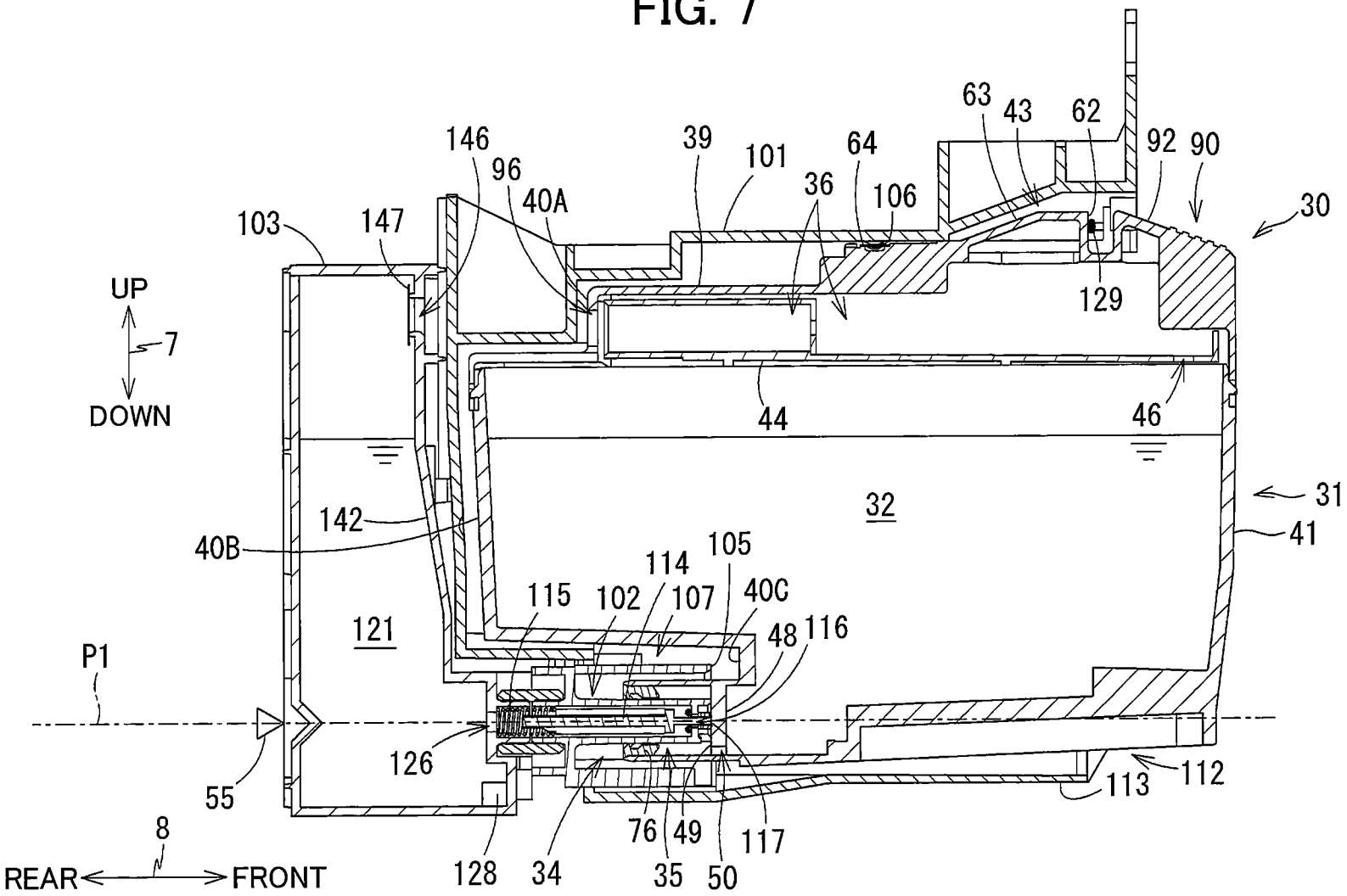
FIG. 7 is a vertical cross-sectional view illustrating the cartridge-attachment portion according to the embodiment and the ink cartridge according to the embodiment in an attached state.

In the following descriptions, the directions (i.e., the up-down direction 7, the front-rear direction 8, and the left-right direction 9) defined above are also used for ink cartridges 30 (described later) attachable to a cartridge-attachment portion 110 (described later) of the MFP 10. More specifically, the directions defined above are used based on an upright posture of the ink cartridge 30. The upright posture denotes a posture when the ink cartridge 30 is in an attached state to the cartridge-attachment portion 110 of the MFP 10 that is in its operable posture. Hence, the ink cartridge 30 is in its upright posture when the ink cartridge 30 is in its attached state. The attached state denotes a state in which the ink cartridge 30 is retained in the cartridge-attachment portion 110 as shown in FIG. 7.

Hereinafter; a rearward direction and a frontward direction in the front-rear direction 8 will be simply referred to as "rearward direction" and "frontward direction", respectively; an upward direction and a downward direction in the up-down direction 7 will be simply referred to as "upward direction" and "downward direction", respectively; and a leftward direction and a rightward direction in the left-right direction 9 will be simply referred to as "leftward direction" and "rightward direction", respectively. The rearward direction in the front-rear direction 8 is an example of the first direction of the present disclosure. The frontward direction in the front-rear direction 8 is an example of the second direction of the present disclosure.

[Overall Structure of the MFP 10]

As shown in FIG. 1, The MFP 10 has a printing unit 11 constituting the lower section of the MFP 10. The printing unit 11 records images on sheets 12 (see FIG. 2) according to an inkjet recording method. The MFP 10 may further possess other various functions, such as a facsimile function, a scan function, and a copy function. The printing unit 11 has a casing 14 formed in a general rectangular parallelepiped shape. As shown in FIG. 2, a sheet tray 15, a discharge tray 16, a feed roller 23, a pair of conveying rollers 25, a pair of discharge rollers 27, a recording unit 24, and a platen 26 are all disposed inside the casing 14.

[Sheet Tray 15, Discharge Tray 16, and Feed Roller 23]

Figure 1B:
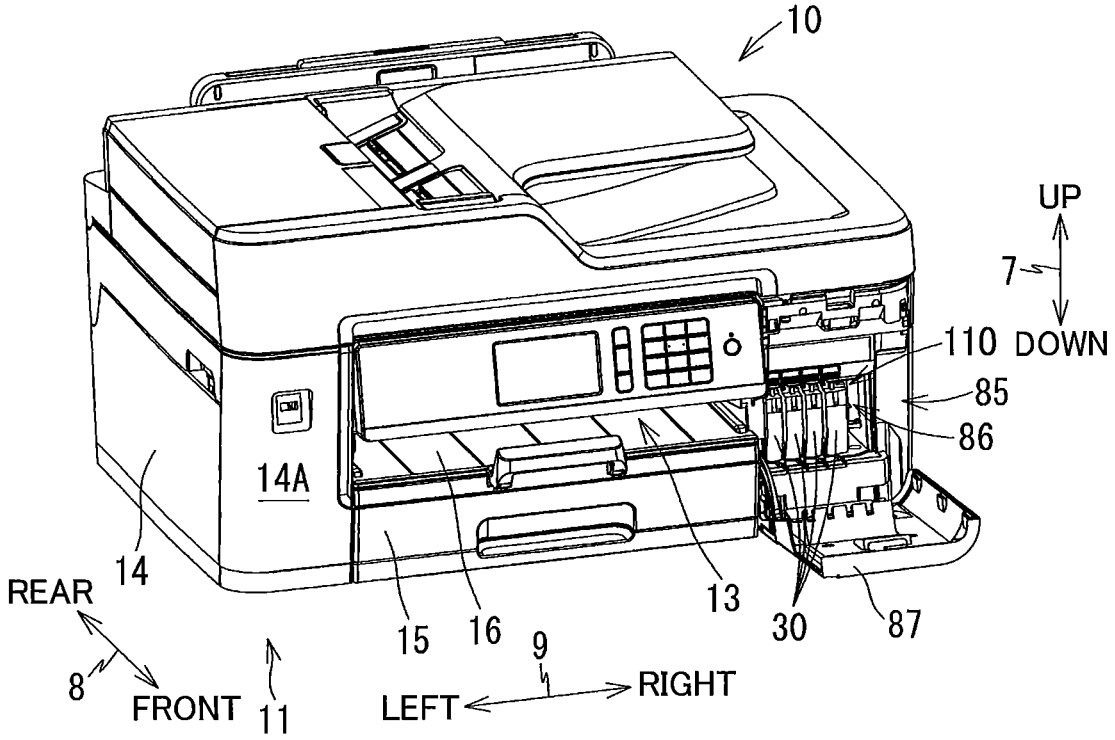
FIG. 1B is a perspective view from the front illustrating the multifunction peripheral according to the embodiment, the view illustrating an external appearance of the multifunction peripheral in a state in which the cover of the multifunction peripheral is in an open position
Figure 2:
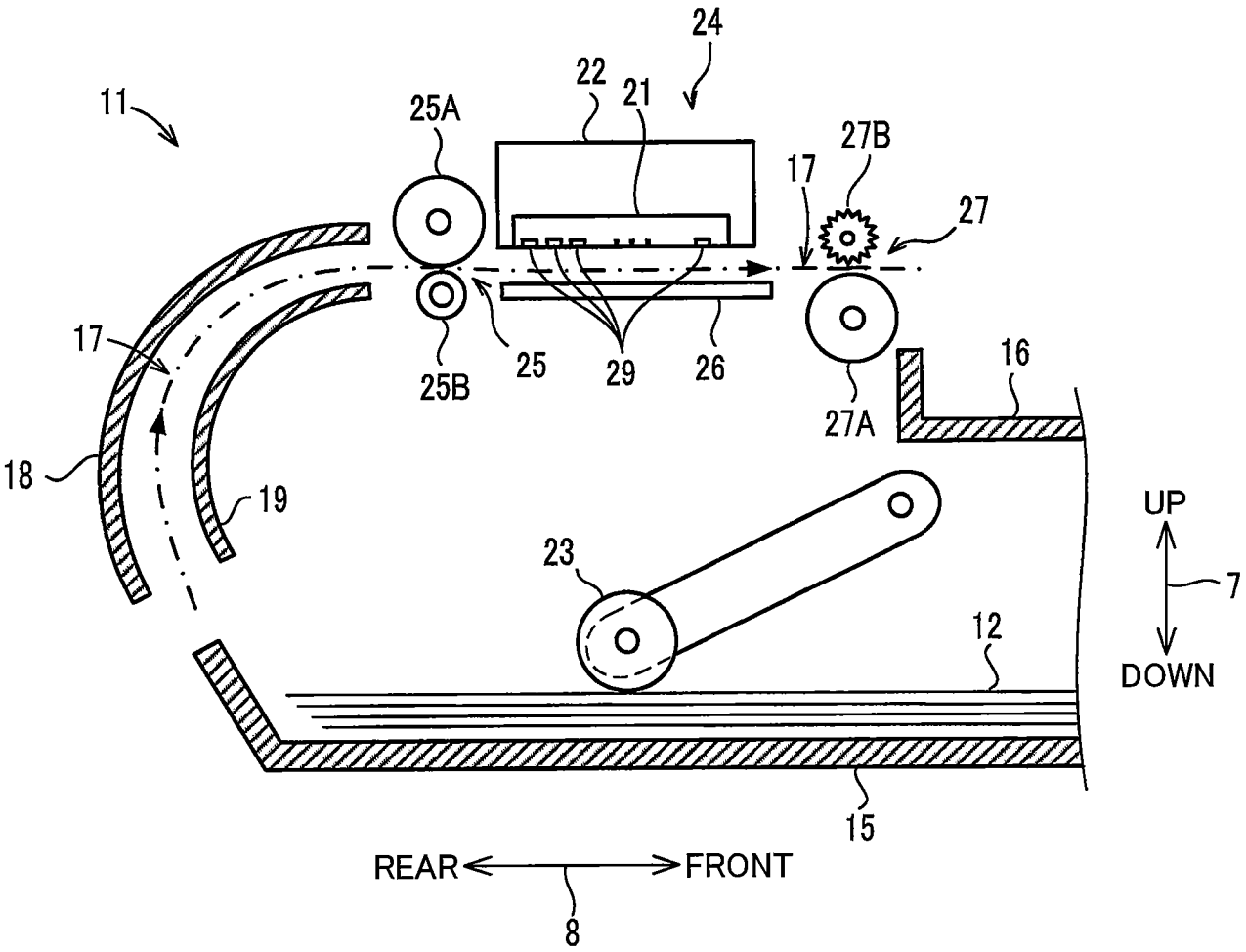
FIG. 2 is a vertical cross-sectional view schematically illustrating an internal structure of a printing unit of the multifunction peripheral according to the embodiment.

As shown in FIGS. 1A, 1B and 2, the casing 14 has a front surface 14A formed with the opening 13. The opening 13 is formed in the approximate center in the left-right direction 9 of the front surface 14A. The sheet tray 15 can be inserted into and extracted from the casing 14 through the opening 13 in the front-rear direction 8. The sheet tray 15 supports a plurality of sheets 12 in a stacked state. The discharge tray 16 is provided above the sheet tray 15. The discharge tray 16 supports sheets 12 discharged from the area between the recording unit 24 and platen 26 by the discharge rollers 27. A motor (not shown) drives the feed roller 23 to feed the sheets 12 supported in the sheet tray 15 onto a conveying path 17 described below.

[Conveying Path 17]

As shown in FIG. 2, the conveying path 17 represents the space formed by guide members 18 and 19, the recording unit 24, the platen 26, and the like. The guide members 18 and 19 are disposed inside the printing unit 11 and face each other with a prescribed gap formed therebetween. The guide members 18 and 19 form the section of the conveying path 17 that leads from the sheet tray 15 to the conveying rollers 25. The recording unit 24 and platen 26 are also disposed inside the printing unit 11 and face each other with a prescribed gap formed therebetween. The recording unit 24 and platen 26 form the section of the conveying path 17 that leads from the conveying rollers 25 to the discharge rollers 27. The conveying path 17 extends upward from the rear end of the sheet tray 15, curves back in the frontward direction, passes through the area facing the recording unit 24, and reaches the discharge tray 16. An arrow formed with a one-dot chain line in FIG. 2 indicates the path and direction of conveyance.

[Conveying Rollers 25]

The conveying rollers 25 are disposed upstream of the recording unit 24 in the conveying direction. The conveying rollers 25 include a conveying roller 25A and a pinch roller 25B that face each other. The conveying roller 25A is driven by a motor (not shown). The pinch roller 25B rotates along with the rotation of the conveying roller 25A. When a forward drive force is transmitted to the conveying roller 25A from the motor, the conveying roller 25A rotates in a forward rotational direction and a sheet 12 pinched between the conveying roller 25A and pinch roller 25B is conveyed along the conveying direction.

[Discharge Rollers 27]

The discharge rollers 27 are disposed downstream of the recording unit 24 in the conveying direction. The discharge rollers 27 include a discharge roller 27A and a spur 27B that face each other. The discharge roller 27A is driven by a motor (not shown). The spur 27B rotates along with the rotation of the discharge roller 27A. When a forward drive force is transmitted to the discharge roller 27A from the motor, the discharge roller 27A rotates in a forward rotational direction and a sheet 12 pinched between the discharge roller 27A and spur 27B is conveyed in the conveying direction.

[Recording Unit 24 and Platen 26]

As shown in FIG. 2, the recording unit 24 and platen 26 are disposed between the conveying rollers 25 and discharge rollers 27 along the conveying direction. More specifically, the recording unit 24 and platen 26 are disposed downstream of the conveying rollers 25 in the conveying direction and upstream of the discharge rollers 27 in the conveying direction. The recording unit 24 and platen 26 are positioned to face each other in the up-down direction 7.

The recording unit 24 is provided with a carriage 22, and a recording head 21 supported by the carriage 22. The carriage 22 reciprocates along the left-right direction 9 when a drive force is transmitted from a motor (not shown). A plurality of nozzles 29 is formed in the bottom surface of the recording head 21. The recording head 21 ejects ink droplets from the nozzles 29 by driving vibrating elements such as piezoelectric elements. The recording head 21 records an image on a sheet 12 supported on the platen 26 by ejecting ink droplets onto the sheet 12 while the carriage 22 reciprocates. When the MFP 10 is in the operable posture, the bottom surface of the recording head 21 is higher than the level of ink contained in ink cartridges 30 attached to the cartridge-attachment portion 110 (see FIG. 3) and higher than the level of ink contained in tanks 103 described later. Also when the MFP 10 is in the operable posture, the recording head 21 is positioned further in the rearward direction than the cartridge-attachment portion 110.

An ink tube and a flexible flat cable are connected to the carriage 22. The ink tube connects the cartridge-attachment portion 110 described later (see FIG. 3) and the recording head 21. More specifically, the ink tube supplies ink (an example of the liquid) stored in the ink cartridges 30 (examples of the liquid cartridge) mounted in the cartridge-attachment portion 110 to the recording head 21. The ink tube is configured of four tubes that are bundled together, with each tube distributing ink from the respective ink cartridges 30 in the corresponding colors (black, magenta, cyan, or yellow). The flexible flat cable electrically connects the recording head 21 and a control board provided in the MFP 10 that controls the operations of the MFP 10.

[Cover 87]

As shown in FIG. 1B, an opening 85 is formed in the front surface 14A of the casing 14 at the right end thereof. The casing 14 has a cover 87 that is pivotally movable between a closed position (the position shown in FIG. 1A) for covering the opening 85, and an open position (the position shown in FIG. 1B) for exposing the opening 85. The cover 87 is supported on the casing 14 near the bottom edge of the casing 14 and can rotate about an pivot axis extending in the left-right direction 9. An accommodating space 86 is formed in the casing 14 to the rear of the opening 85 and is in communication with the opening 85.

[Cartridge-Attachment Portion 110]

Figure 3:
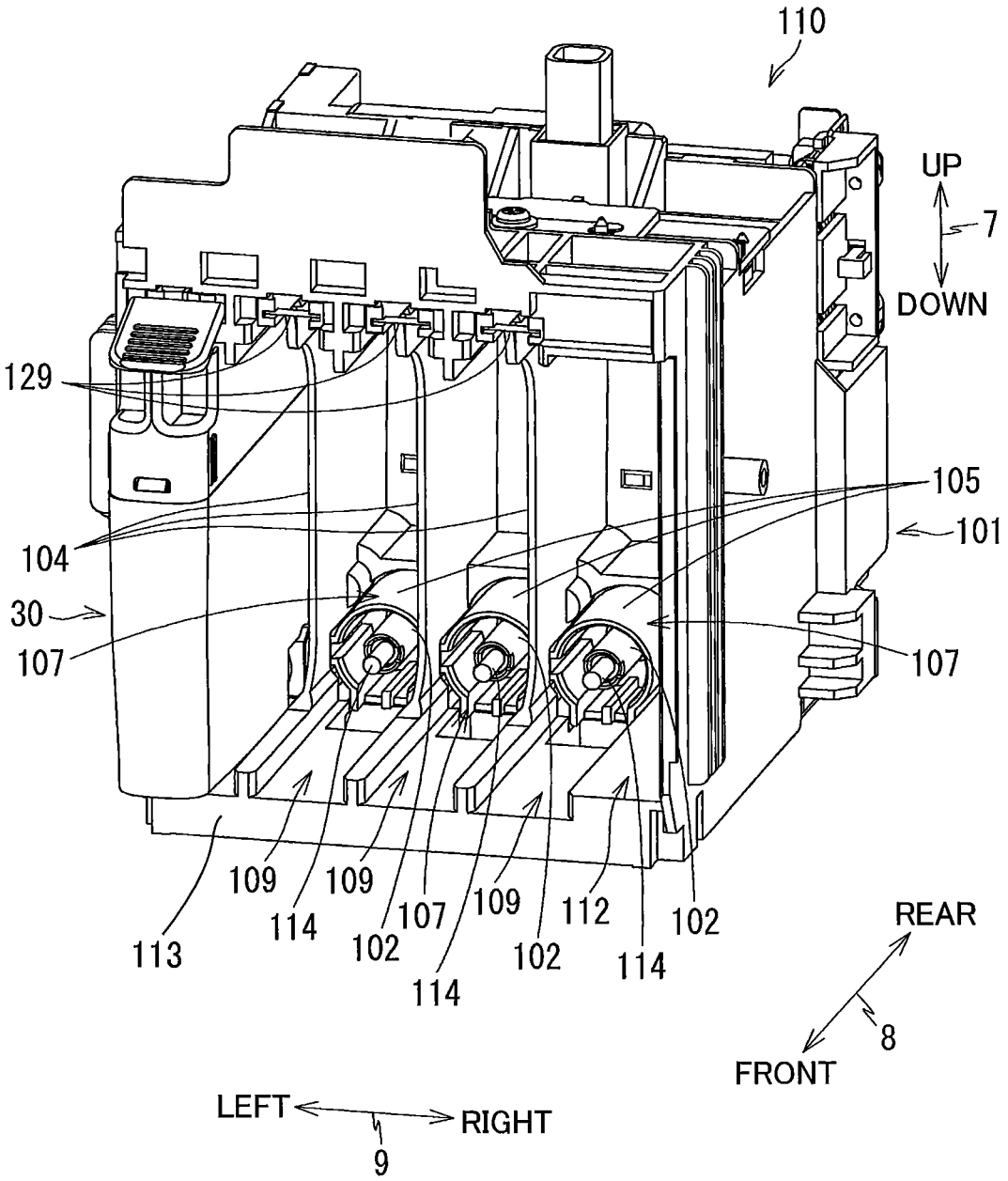
FIG. 3 is a perspective view of a cartridge-attachment portion of the multifunction peripheral according to the embodiment.
Figure 4:
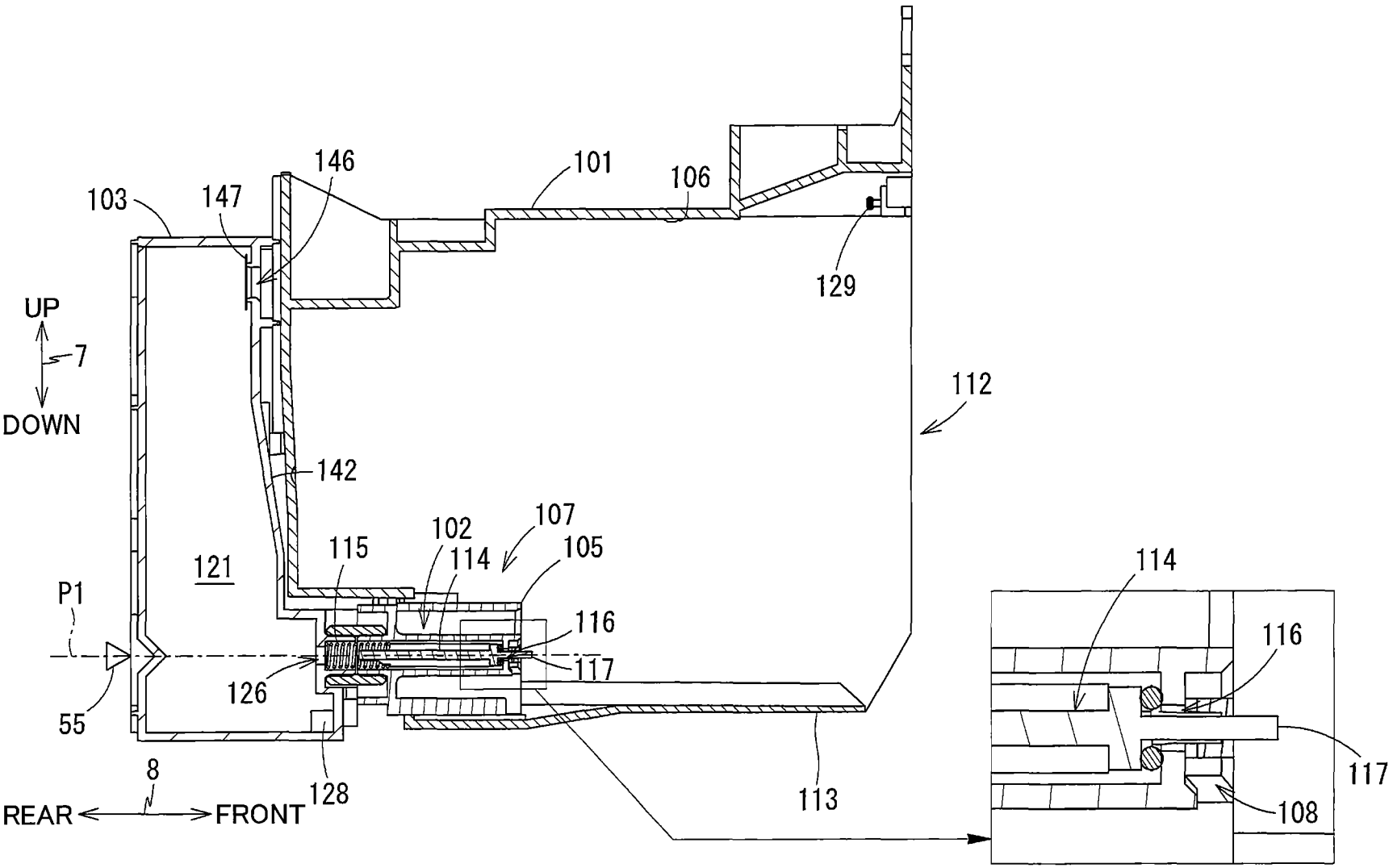
FIG. 4 is a vertical cross-sectional view of the cartridge-attachment portion of the multifunction peripheral according to the embodiment.

As shown in FIGS. 3 and 4, the cartridge-attachment portion 110 is disposed in the accommodating space 86. The cartridge-attachment portion 110 is provided with a cartridge case 101, a locking part 129, tanks 103, contacts 106, and liquid level sensors 55. Four ink cartridges 30 corresponding to the four colors cyan, magenta, yellow, and black can be accommodated in and attached to the cartridge-attachment portion 110. One tank 103, four contacts 106, and one liquid level sensor 55 are provided for each of the four ink cartridges 30. Note that the number of ink cartridges 30 that can be accommodated in and attached to the cartridge-attachment portion 110 is not limited to four. In FIG. 3, one of the four ink cartridges 30 has been accommodated in and attached to the left side of the cartridge-attachment portion 110 and the other ink cartridges 30 have not been attached to the cartridge-attachment portion 110. The cartridge-attachment portion 110 is an example of the attachment portion of the present disclosure. A system including the ink cartridge 30 and the cartridge-attachment portion 110 is an example of the system of the present disclosure.

The cartridge case 101 constitutes the housing of the cartridge-attachment portion 110. The cartridge case 101 has a box shape with interior space for accommodating the ink cartridges 30. That is, the cartridge case 101 provides an accommodation space for accommodating therein the ink cartridges 30 in their attached state in which the ink cartridges 30 are attached to the cartridge-attachment portion 110. An opening 112 for exposing the interior space of the cartridge case 101 is formed in the front side of the cartridge case 101 opposite the inner back wall in the front-rear direction 8. When the cover 87 is in the open position, the opening 112 is exposed to the outside of the MFP 10 through the opening 85 formed in the casing 14. The cartridge case 101 is an example of the holder of the present disclosure.

The ink cartridges 30 are inserted in the rearward direction into the cartridge-attachment portion 110 through the opening 85 of the casing 14 and the opening 112 of the cartridge-attachment portion 110. In the present embodiment, the rearward direction is an insertion direction in which the ink cartridge 30 is inserted into the accommodation space of the cartridge case 101. The ink cartridges 30 are extracted in the frontward direction from the cartridge-attachment portion 110 through the opening 112 and opening 85. Guide grooves 109 are formed at intervals in the left-right direction 9 in a bottom wall 113 of the cartridge case 101. Each ink cartridge 30 is guided along the front-rear direction 8 by inserting the bottom end of the ink cartridge 30 in the corresponding guide groove 109. Three plates 104 are provided in the cartridge case 101. The plates 104 partition the interior space of the cartridge case 101 into four spaces adjacent to each other in the left-right direction 9. Each of the four spaces partitioned by the plates 104 accommodates the corresponding one of the four ink cartridges 30 that store inks of different colors.

[Contacts 106]

As shown in FIG. 4, the contacts 106 are provided on the inner surface of the top wall defining the interior space of the cartridge case 101. The four contacts 106 are provided for each of the four ink cartridges 30 that can be accommodated in the cartridge case 101.

The contacts 106 are positioned further in the frontward direction than ink supply tubes 102 described later. The contacts 106 protrude in the downward direction from the inner surface of the top wall into the interior space (i.e., the accommodation space) of the cartridge case 101. The contacts 106 face in the downward direction. The contacts 106 are configured of elastic members that are electrically conductive and can be elastically deformed in the upward direction. While not shown in detail in the drawings, the four contacts 106 in the interior space of the cartridge case 101 are juxtaposed at intervals in the left-right direction 9. The arrangement of the four contacts 106 corresponds to the arrangement of four electrodes 65 (described later) on the corresponding ink cartridge 30. Note that the number of contacts 106 and the number of electrodes 65 is arbitrary.

The contacts 106 are electrically connected to the control board in the MFP 10 via an electric circuit. When the four contacts 106 contact the corresponding four electrodes 65 described later and electricity can be conducted therebetween, a voltage Vc is applied to one of the four electrodes 65, another electrode 65 is grounded, and another electrode 65 is supplied with electric power. Through these electrical connections between the contacts 106 and electrodes 65, the control board in the MFP 10 can access ICs (integrated circuits) on the ink cartridges 30 to read data from or write data to memory on the ICs.

[Locking Part 129]

As shown in FIGS. 3 and 4, the locking part 129 extends through the interior space of the cartridge case 101 along the left-right direction 9 at a position near the top wall of the cartridge case 101 and the opening 112. The locking part 129 is a rod-shaped member that extends in the left-right direction 9. For example, the locking part 129 is a circular cylinder made of metal. The ends of the locking part 129 in the left-right direction 9 are fixed in the side walls of the cartridge case 101. The locking part 129 extends along the left-right direction 9 through the four spaces that are used for accommodating the four ink cartridges 30. The circumferential surface of the locking part 129 is an example of the locking surface of the present disclosure.

The locking part 129 functions to retain the ink cartridges 30 in their locking positions (described later) shown in FIG. 7 after the ink cartridges 30 have been attached to the cartridge-attachment portion 110. The locking part 129 is capable of contacting the ink cartridges 30 accommodated in the accommodation space. The ink cartridges 30 contacts the locking part 129 when attached to the cartridge-attachment portion 110. With this configuration, the locking part 129 maintains the ink cartridges 30 at their attached states against the urging forces of coil springs 115 (described later) by contacting the ink cartridges 30 accommodated in the accommodation space. Each of the coil springs 115 urges the corresponding ink cartridge 30 in the rearward direction.

[Tanks 103]

As shown in FIG. 4, the tanks 103 are provided on the rear side of the cartridge case 101. Of the walls constituting each tank 103, at least the region (a prism) facing the corresponding liquid level sensor 55 (described later) is translucent to allow the passage of light outputted from the liquid level sensor 55.

The tank 103 has a box shape whose interior constitutes a storage chamber 121. The storage chamber 121 is in communication with the ink tube via an outlet 128. The outlet 128 is formed near the bottom wall defining the bottom of the storage chamber 121. The outlet 128 is positioned further in the downward direction than a connector 107 (described later). With this configuration, ink stored in the storage chamber 121 flows out of the storage chamber 121 through the outlet 128 and is supplied to the recording head 21 via the ink tube.

The tank 103 also has a front wall 142 defining the front side of the storage chamber 121. A communication hole 146 and a through-hole 126 are formed in the front wall 142. The communication hole 146 penetrates the front wall 142 at a position near the top of the storage chamber 121. A semipermeable membrane 147 is affixed across the inner side opening of the communication hole 146 to close the opening in the front wall 142. The semipermeable membrane 147 has a surface exposed to the storage chamber 121. The surface exposed to the storage chamber 121 extends along the up-down direction 7 and left-right direction 9. The semipermeable membrane 147 restricts the passage of ink while allowing the passage of air. Thus, the storage chamber 121 is in communication with the atmosphere via the communication hole 146 and semipermeable membrane 147. The through-hole 126 penetrates the front wall 142 of the tank 103 near the bottom of the storage chamber 121 and provides communication between the storage chamber 121 and the interior space of a corresponding ink supply tube 102 described below.

[Connectors 107]

As shown in FIGS. 3 and 4, four connectors 107 are disposed in the cartridge-attachment portion 110 for the four ink cartridges 30. Each connector 107 is provided with a tube-shaped ink supply tube 102 that is formed of a resin, a valve 114, a protrusion 117, a coil spring 115, and a guide part 105. The ink supply tube 102 protrudes in the frontward direction from the tank 103. An opening 116 is formed in the distal (front) end of the ink supply tube 102. As shown in FIG. 4, the opening 116 opens toward the accommodation space provided by the cartridge case 101. The interior space of the ink supply tube 102 extends along the front-rear direction 8 and is in communication with the storage chamber 121 of the corresponding tank 103 via the corresponding through-hole 126 formed in the front wall 142 of the tank 103. This interior space serves as an ink communication passage. Each ink supply tube 102 is disposed in the cartridge-attachment portion 110 at a position corresponding to an ink supply cylinder 34 (see FIG. 7) of the corresponding ink cartridge 30 in the attached state.

The guide part 105 is a cylindrically shaped member arranged around the corresponding ink supply tube 102. The guide part 105 protrudes in the frontward direction from the tank 103. An opening is formed in the distal end (the front end) of the guide part 105. The ink supply tube 102 is disposed in the diametrical center of the guide part 105. When the ink cartridge 30 is attached to the cartridge-attachment portion 110, the ink supply cylinder 34 of the ink cartridge 30 is inserted into the corresponding guide part 105. The ink supply tube 102 is an example of the tube of the present disclosure.

The valve 114 and coil spring 115 are accommodated in the interior space of the ink supply tube 102. The valve 114 is movable in the front-rear direction 8 within the interior space of the ink supply tube 102 between a closed position closing the opening 116 and an open position opening the opening 116. In the closed position, the valve 114 closes the opening 116 to interrupt communication between the outside of the ink supply tube 102 and the interior space of the ink supply tube 102. In the open position, the valve 114 opens the opening 116 to allow the communication between the outside of the ink supply tube 102 and the interior space of the ink supply tube 102. The coil spring 115 urges the valve 114 in the frontward direction, i.e., toward the closed position. The coil spring 115 is an example of the spring of the present disclosure.

The protrusion 117 protrudes from the front end of the valve 114 along the front-rear direction 8 toward the outside of the ink supply tube 102, i.e., toward the accommodation space provided by the cartridge case 101. In the present embodiment, the protrusion 117 protrudes in the frontward direction. When the valve 114 is in its closed position, the protrusion 117 protrudes further in the frontward direction than the opening 116. That is, when the valve 114 is in the closed position, the protrusion 117 protrudes into the interior space of the cartridge case 101 (i.e., the accommodation space provided by the cartridge case 101) through the opening 116.

[Liquid Level Sensors 55]

Each liquid level sensor 55 outputs a low level signal to the control board when the level of ink accommodated in the storage chamber 121 is higher than a borderline P1 and outputs a high level signal to the control board when the level of ink is lower than or even with the borderline P1. The liquid level sensor 55 optically detects the level of ink in the storage chamber 121 using a prism whose reflectance varies depending on whether ink is in contact with the side wall of the storage chamber 121.

[Ink Cartridges 30]

Figure 5:
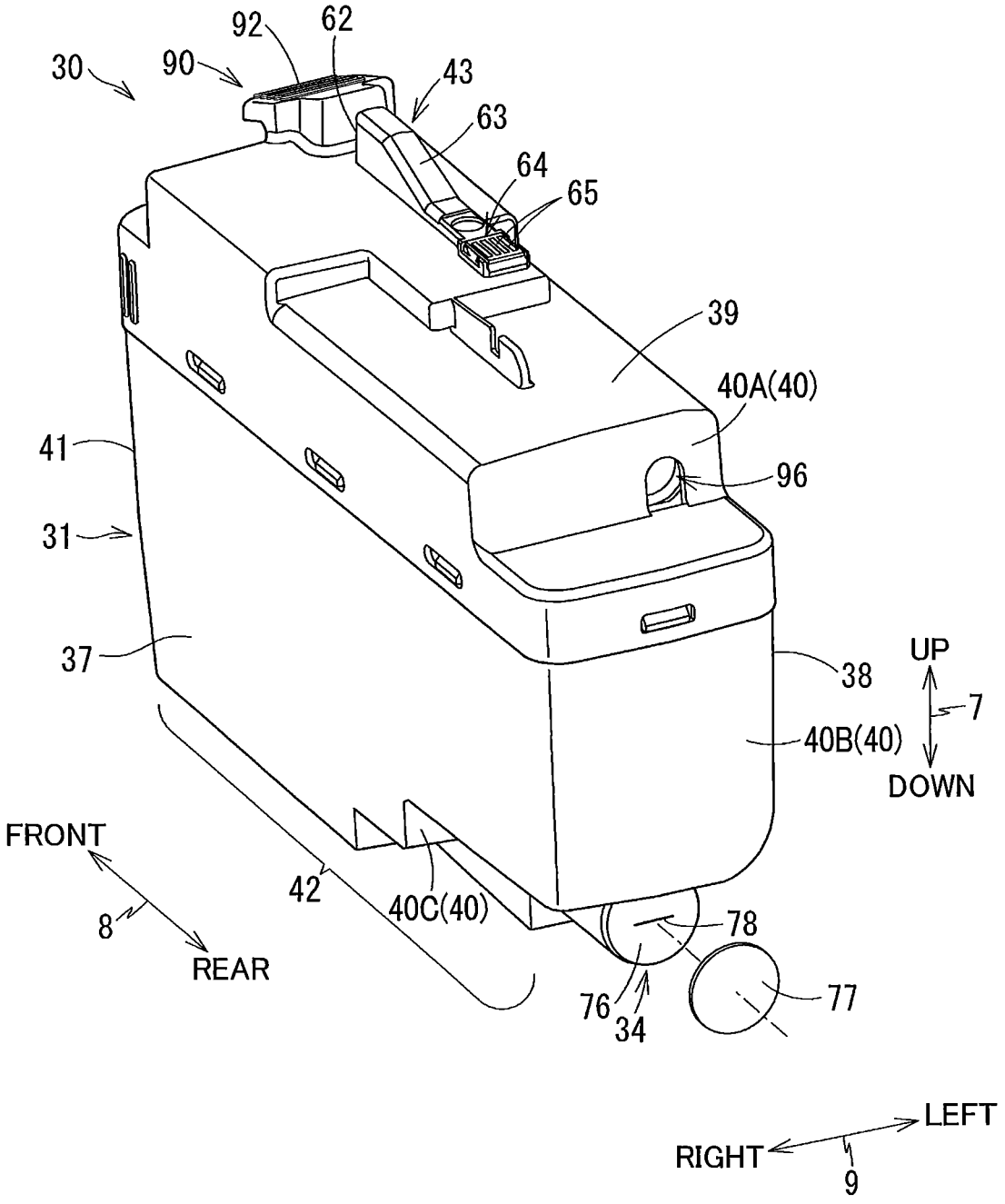
FIG. 5 is a perspective view from the front illustrating an ink cartridge according to the embodiment.

The ink cartridge 30 is a vessel that stores ink. The ink cartridge 30 has a housing 31, the ink supply cylinder 34, a protruding part 43, and an operating part 90. As shown in FIG. 5, the housing 31 of the ink cartridge 30 has a general rectangular parallelepiped shape. The ink cartridge 30 is formed in a flattened shape, whereby its dimensions along the up-down direction 7 and front-rear direction 8 are greater than the dimension along the left-right direction 9. The ink cartridges 30 that store different colors of ink may be formed in the same external shape or different external shapes.

The housing 31 has a rear wall 40 (40A, 40B, and 40C), a front wall 41, a top wall 39, a bottom wall 42, and side walls 37 and 38. The rear wall 40 is positioned further in the rearward direction than the front wall 41. The front wall 41 and rear wall 40 are spaced away from each other in the front-rear direction 8 with a storage chamber 32 (described later) interposed between the front wall 41 and rear wall 40. The top wall 39 and bottom wall 42 are spaced away from each other in the up-down direction 7 with the storage chamber 32 interposed between the top wall 39 and bottom wall 42. The top wall 39 and bottom wall 42 connect the front wall 41 and rear wall 40. The ink cartridge 30 is an example of the liquid cartridge of the present disclosure. The rear wall 40 is an example of the first wall of the present disclosure. The front wall 41 is an example of the second wall of the present disclosure. The top wall 39 is an example of the third wall of the present disclosure. The bottom wall 42 is an example of the fourth wall of the present disclosure.

The rear wall 40 has a first rear wall 40A, a second rear wall 40B, and a third rear wall 40C. The first rear wall 40A is positioned further in the frontward direction and further in the upward direction than the second rear wall 40B. The second rear wall 40B is positioned further in the rearward direction and further in the upward direction than the third rear wall 40C. The third rear wall 40C is positioned further in the frontward direction and further in the downward direction than the first rear wall 40A. An air communication hole 96 is formed in the first rear wall 40A. The ink supply cylinder 34 is provided at the third rear wall 40C.

The protruding part 43 and operating part 90 are provided at the top wall 39. The protruding part 43 protrudes in the upward direction from the outer surface of the top wall 39 and is elongated in the front-rear direction 8. The protruding part 43 has a locking surface 62 that faces in the frontward direction. The locking surface 62 is positioned further in the upward direction than the top wall 39. The locking surface 62 of the ink cartridge 30 in the attached state contacts the locking part 129.

As shown in FIG. 7, the ink cartridge 30 is maintained in its attached state against the urging force of the coil spring 115 by the locking part 129 contacting the ink cartridge 30. In other words, the ink cartridge 30 is maintained in its attached state against the urging force of the coil spring 115 through contact between the locking surface 62 and locking part 129. In the attached state illustrated in FIG. 7, the ink cartridge 30 is positioned in the locking position, in which the locking surface 62 faces the locking part 129 in the rearward direction (i.e., in the insertion direction) and is in contact with the locking part 129. The rear portion of the protruding part 43 has a sloped surface 63. The sloped surface 63 slopes in the downward direction toward the rear so as to face diagonally upward and rearward.

The operating part 90 is provided at the top wall 39 and positioned further in the frontward direction than the locking surface 62. The operating part 90 has an operating surface 92. When the operating surface 92 of the operating part 90 of the ink cartridge 30 in the attached state is pressed in the downward direction, the ink cartridge 30 is pivotally moved. More specifically, when the operating surface 92 is pressed in the downward direction, the ink cartridge 30 is pivotally moved from the locking position (FIG. 7) to a releasing position (FIG. 12) about the point of contact between the ink supply tube 102 and the inner surface of a sealing member 76 (described later) which surface defines a slit 78 (described later). That is, the ink cartridge 30 is pivotally movable between the locking position and the releasing position in a state in which the ink supply tube 102 extends through the sealing member 76.

Figure 12:
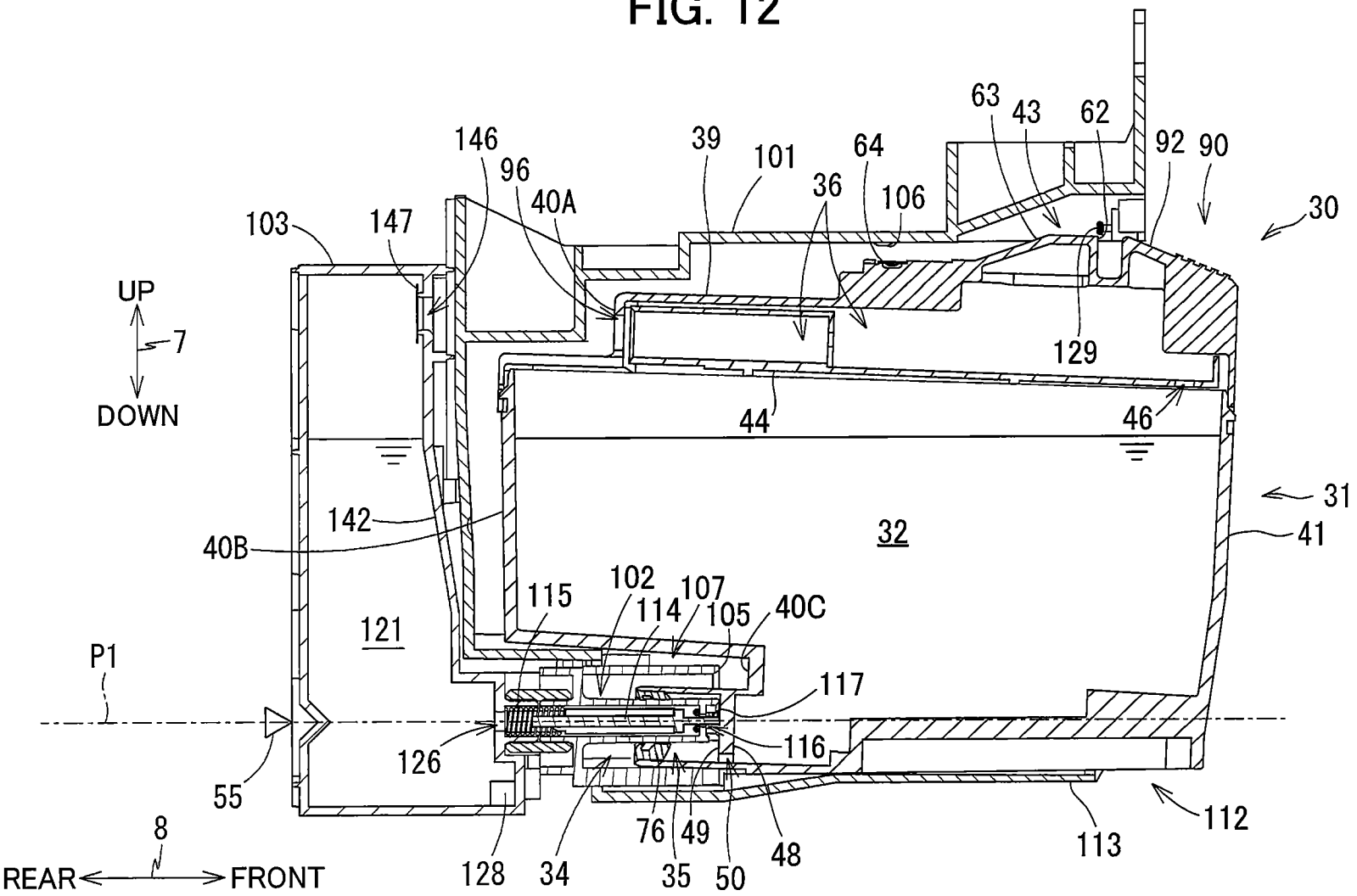
FIG. 12 is a vertical cross-sectional view illustrating the cartridge-attachment portion according to the embodiment and the ink cartridge according to the embodiment that is in a releasing position.

As shown in FIG. 12, in a state in which the ink cartridge 30 is in the releasing position, the locking surface 62 is positioned further in the downward than the locking part 129. Accordingly, the locking surface 62 of the ink cartridge 30 in the releasing position does not face the locking part 129 in the rearward direction and is not in contact with the locking part 129. From the releasing position, the ink cartridge 30 can be pulled out of the cartridge-attachment portion 110. The locking surface 62 is an example of the portion of the liquid cartridge of the present disclosure. The locking position is an example of the facing position of the present disclosure. The releasing position is an example of the non-facing position of the present disclosure.

[IC Board 64]

Figure 6:
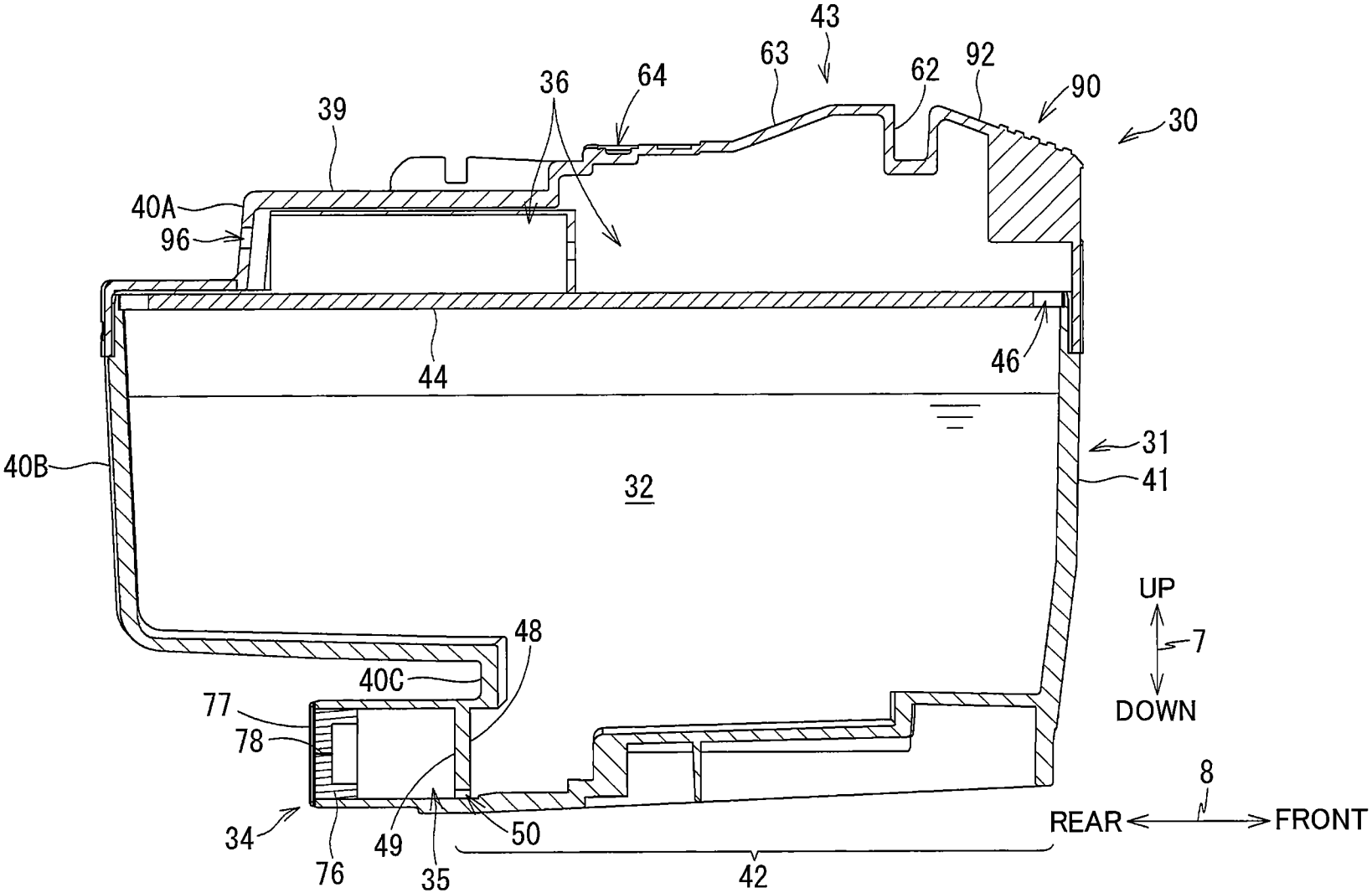
FIG. 6 is a vertical cross-sectional view of the ink cartridge according to the embodiment.

As shown in FIGS. 5 and 6, an IC board 64 is provided at the top wall 39. The IC board 64 faces in the upward direction when the ink cartridge 30 is in the attached state. The IC board 64 is positioned further in the rearward direction than the sloped surface 63. The IC board 64 is a plate that extends in the left-right direction 9 and front-rear direction 8 when the ink cartridge 30 is in the attached state. The IC board 64 is an example of the circuit board of the present disclosure.

The IC board 64 comes into contact with and becomes electrically connected to the corresponding contacts 106 in a process of insertion of the ink cartridge 30 into the cartridge-attachment portion 110. Also, in the attached state of the ink cartridge 30, the IC board 64 is in contact with and is electrically connected to the contacts 106.

The IC board 64 is configured by mounting an IC (integrated circuit) not shown in the drawings and four electrodes 65 on a substrate formed of silicon, glass epoxy, or the like. Note that the IC board 64 may also be configured of a flexible substrate having a flexibility.

The integrated circuit is a semiconductor integrated circuit. Information related to the ink cartridge 30 is stored in the integrated circuit in a readable form. The information related to the ink cartridge 30 is data specifying the lot number, manufactured date, ink colors, and the like.

Each electrode 65 is electrically connected to the integrated circuit. The electrodes 65 extend along the front-rear direction 8 on the top surface of the IC board 64 and are arranged parallel to each other while spaced apart in the left-right direction. Each electrode 65 is exposed on the top surface of the IC board 64 so as to be electrically accessible.

As shown in FIG. 6, the storage chamber 32, a communication chamber 35 and an air chamber 36 are formed in the interior space of the housing 31. The storage chamber 32 and communication chamber 35 store ink. The air chamber 36 is positioned between the storage chamber 32 and the outside of the housing 31 and is in communication with the atmosphere.

The storage chamber 32 and the communication chamber 35 are partitioned in the front-rear direction 8 by a partition wall 48 of the rear wall 40. The rear surface of the partition wall 48 constitutes a contact surface 49 facing the communication chamber 35. That is, the partition wall 48 of the rear wall 40 defines at least a portion of the communication chamber 35. The contact surface 49 is a flat surface extending along the up-down direction 7 and left-right direction 9 and facing in the rearward direction. A through-hole 50 is formed in the bottom portion of the partition wall 48. Ink can flow between the storage chamber 32 and communication chamber 35 via the through-hole 50. The contact surface 49 of the partition wall 48 is an example of the surface of the present disclosure.

The storage chamber 32 and air chamber 36 are arranged adjacent to each other in the up-down direction 7 in the interior space of the housing 31 and are separated from each other by a partition wall 44. A through-hole 46 is formed in the front portion of the partition wall 44 for providing communication between the storage chamber 32 and the air chamber 36. The air chamber 36 is an air channel provided above the storage chamber 32. A labyrinth channel or a semipermeable membrane (not shown) may be disposed in the air chamber 36. The storage chamber 32 is an example of the liquid chamber of the present disclosure.

The ink supply cylinder 34 protrudes in the rearward direction from the third rear wall 40C. The ink supply cylinder 34 is a cylindrically shaped member. The interior space of the ink supply cylinder 34 constitutes the communication chamber 35. The distal (rear) end of the ink supply cylinder 34 is open to the outside of the ink cartridge 30. In That is, the communication chamber 35 extends from the storage chamber 32 in the rearward direction and the rear end of the communication chamber 35 is formed with an open end. The communication chamber 35 serves as a communication passage for communicating the storage chamber 32 with the outside of the ink cartridge 30. The second rear wall 40B is positioned further in the rearward direction than the distal end of the ink supply cylinder 34. The opening formed in the distal end of the ink supply cylinder 34, i.e., the open end of the communication chamber 35 is sealed by the sealing member 76 and a film 77. The communication chamber 35 is an example of the communication passage of the present disclosure.

As shown in FIGS. 5 and 6, the sealing member 76 is a disc-shaped member formed of an elastic material, such as rubber. The sealing member 76 is fitted to the rear portion of the communication chamber 35. The slit 78 is formed in the center in the up-down direction 7 of the sealing member 76. In the attached state, the slit 78 extends in a direction crossing the gravitational direction. In the present embodiment, in the attached state, the slit 78 extends in the left-right direction 9 and penetrates the sealing member 76 in the front-rear direction 8. When the ink supply tube 102 is inserted into the slit 78, as illustrated in FIG. 7, the sealing member 76 is elastically deformed into an open shape opening the slit 78 to allow such insertion. When the ink supply tube 102 is extracted from the slit 78, as illustrated in FIG. 6, the sealing member 76 is elastically restored to a closed shape closing the slit 78. That is, the sealing member 76 is elastically deformable between the open shape and the closed shape and the ink supply tube 102 can be inserted into the communication chamber 35 through the slit 78. Note that there is no particular restriction on the shape of the slit 78. For example, the slit 78 may extend along the up-down direction 7 or may extend in radial directions like a cross. The length of the slit 78 is greater than the outer diameter of the ink supply tube 102.

As shown in FIG. 5, the film 77 is affixed to the distal end of the ink supply cylinder 34 to seal the open end of the communication chamber 35 and cover the sealing member 76. The film 77 is configured of a sheet formed of synthetic resin that does not allow passage of ink and is affixed to the distal end of the ink supply cylinder 34 by welding or adhesion, for example. To use the ink cartridge 30, the user peels the film 77 off the ink supply cylinder 34 prior to inserting the ink cartridge 30 into the ink supply tube 102. Alternatively, the ink supply tube 102 punctures the film 77 in a process of insertion of the ink cartridge 30 into the ink supply tube 102. In the example of FIG. 5, the film 77 has been peeled off the distal end of the ink supply cylinder 34.

As shown in FIG. 6, the contact surface 49 of the partition wall 48 is positioned closer to the storage chamber 32 in the front-rear direction 8 than the sealing member 76 to the storage chamber 32 in the front-rear direction 8. The contact surface 49 faces the sealing member 76 in the front-rear direction 8 and is spaced away from the sealing member 76 in the front-rear direction 8. Thus, the contact surface 49 of the partition wall 48 is not in contact with the sealing member 76.

During the process of attaching the ink cartridge 30 to the cartridge-attachment portion 110 (i.e. in the process from the start of insertion of the ink cartridge 30 into the accommodation space to the completion of attachment of the ink cartridge 30 to the cartridge-attachment portion 110), the ink supply tube 102 of the cartridge-attachment portion 110 is inserted into the slit 78 through the open end of the communication chamber 35 while elastically deforming the sealing member 76, and then the ink supply tube 102 passes through the sealing member 76 and advances into the communication chamber 35.

Figure 11:
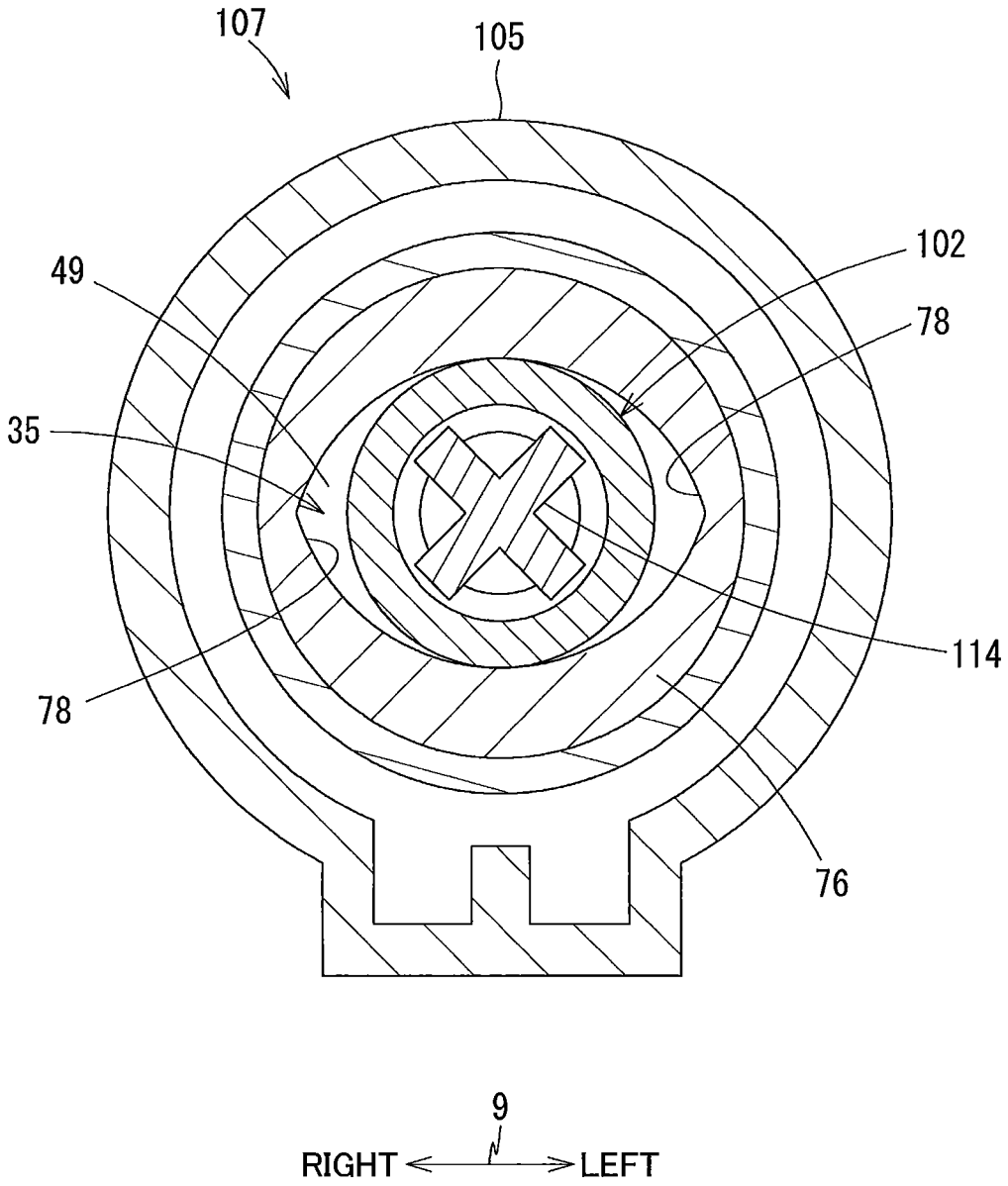
FIG. 11 is a cross-sectional view taken along line XI-XI shown in FIG. 8, the view illustrating a connector of the cartridge-attachment portion according to the embodiment and a sealing member of the ink cartridge according to the embodiment.

As described above, the slit 78 extends along a horizontal direction (along the left-right direction 9). Thus, as illustrated in FIG. 11, in a state in which the ink supply tube 102 is inserted into the slit 78 and the sealing member 76 is elastically deformed, the inner surfaces of the sealing member 76 which surfaces define the slit 78 are in pressure contact with the top and bottom of the ink supply tube 102. Further, on the left and right sides of the ink supply tube 102, small gaps are formed between the ink supply tube 102 and the deformed inner surfaces of the sealing member 76. Thus, ink is unlikely to leak out of the elastically deformed sealing member 76 since a gap between the inner surfaces of the sealing member 76 and the bottom portion of the ink supply tube 102 is unlikely to be formed.

Figure 13:
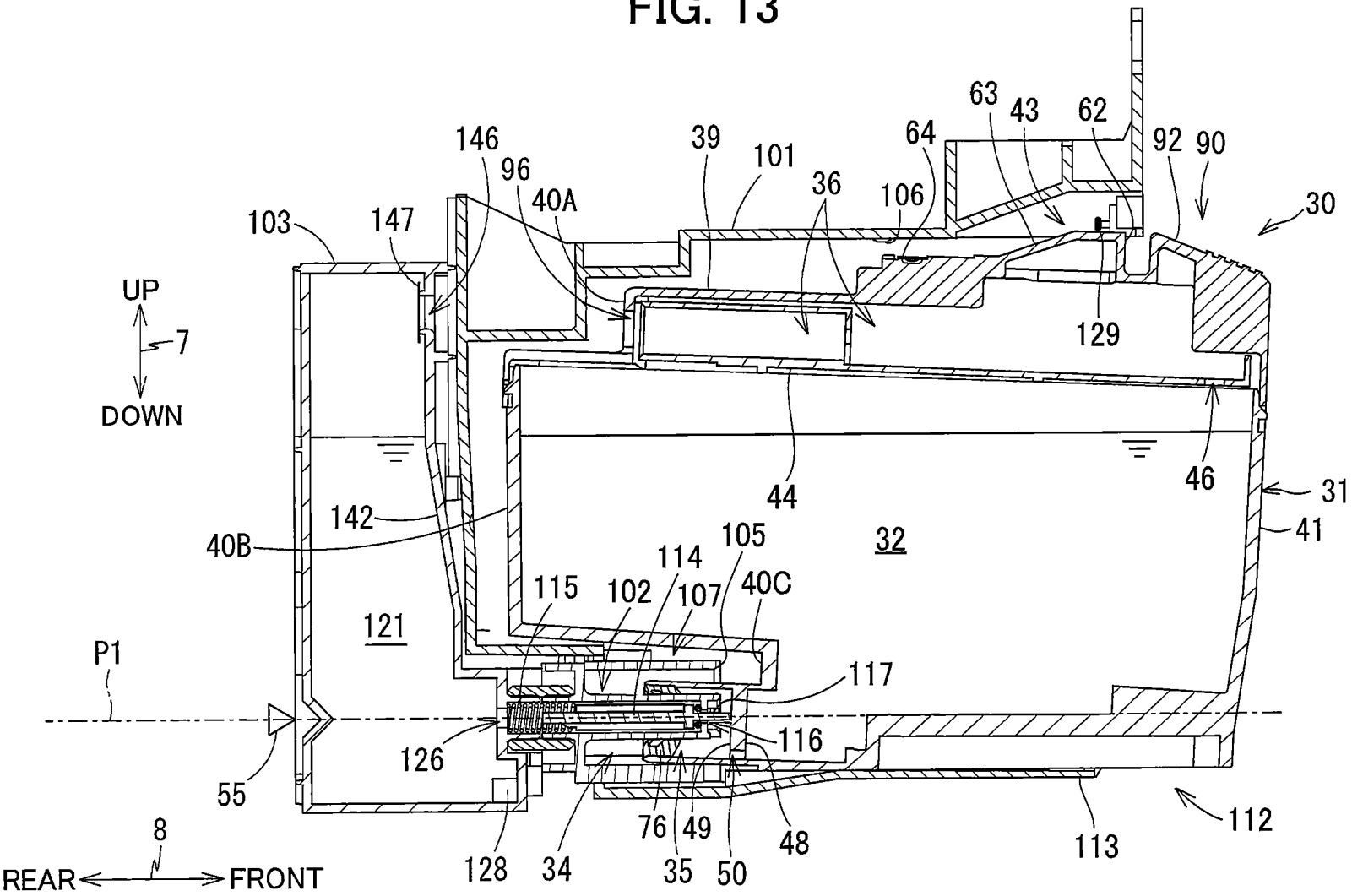
FIG. 13 is a vertical cross-sectional view illustrating the cartridge-attachment portion according to the embodiment and the ink cartridge according to the embodiment in a process of inserting the ink cartridge into the cartridge-attachment portion, the view illustrating a state in which a contact surface of the ink cartridge is in contact with a protrusion of the cartridge-attachment portion contacts but is not in contact with an ink supply tube of the cartridge-attachment portion.

When the ink cartridge 30 is further inserted into the cartridge-attachment portion 110 after the ink supply tube 102 enters the communication chamber 35, the protrusion 117 protruding from the valve 114 in the closed position within the ink supply tube 102 contacts the contact surface 49 as shown in FIG. 13. In the state illustrated in FIG. 13, the valve 114 is still remains in the closed position.

When the ink cartridge is further inserted into the ink cartridge 30 from the state of FIG. 13, the valve 114 is moved by the contact surface 49 from the closed position to the open position against the urging force of the coil spring 115. Subsequently, the contact surface 49 of the partition wall 48 contacts the distal end of the ink supply tube 102, thereby preventing the ink cartridge 30 from further moving in the rearward direction relative to the cartridge-attachment portion 110. After then, the ink cartridge 30 is pivotally moved from the releasing position (FIG. 12) to the locking position (FIG. 7) while the contact surface 49 is in contact with both the protrusion 117 and the distal end of the ink supply tube 102. As a result, the ink cartridge 30 is placed in its attached state, thereby completing the attachment of the ink cartridge 30 to the cartridge-attachment portion 110. In this way, in the process of attaching the ink cartridge 30 to the cartridge-attachment portion 110, the protrusion 117 contacts the contact surface 49 and then the ink supply tube 102 contacts the contact surface 49.

Figure 8:
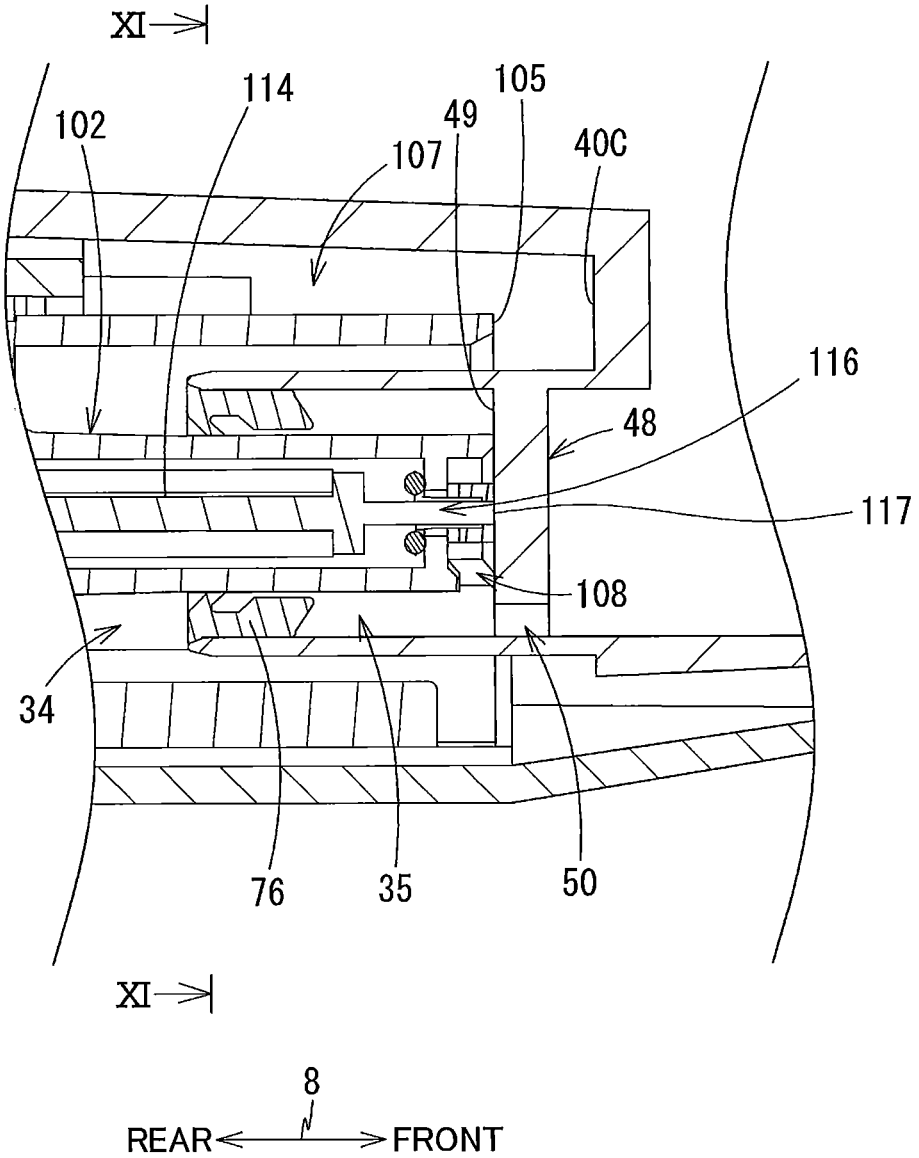
FIG. 8 is an elongated vertical cross-sectional view illustrating a vicinity of a communication chamber of the ink cartridge according to the embodiment in the attached state.

As illustrated in FIGS. 7 and 8, in the attached state, the ink supply tube 102 extends through both the open end of the communication chamber 35 and the sealing member 76 and the opening 116 of the ink supply tube 102 is positioned in the communication chamber 35. Further, in the attached state, the contact surface 49 is in contact with both the protrusion 117 and the ink supply tube 102 and the valve 114 is in its open position. More specifically, in the attached state, the contact surface 49 is in contact with the protrusion 117 to maintain the valve 114 at its open position against the urging force of the coil spring 115.

When the valve 114 is in the open position, ink can flow between the communication chamber 35 and the interior space of the ink supply tube 102. Specifically, a notch 108 (see FIG. 8) is formed in the distal end of the ink supply tube 102. The notch 108 allows ink in the communication chamber 35 to flow into the interior space of the ink supply tube 102. As a result, ink stored in the storage chamber 32 flows through the interior space of the ink supply tube 102 into the storage chamber 121 of the tank 103 owing to the head differential.

[Effects of the Embodiment]

During the process of attaching the ink cartridge 30 to the cartridge-attachment portion 110 according to the present embodiment described above, contact between the contact surface 49 of the partition wall 48 and the protrusion 117 of the connector 107 moves the valve 114 to its open position against the urging force of the coil spring 115. Since the ink cartridge 30 need only be retained in the cartridge-attachment portion 110 against the urging force of the coil spring 115 in order to maintain the valve 114 in its open position, the load applied by the locking part 129 to the ink cartridge 30 via the locking surface 62 is small compared with a configuration in which a valve and spring are provided in each of an ink cartridge and an ink supply tube of a cartridge-attachment portion. Accordingly, the ink cartridge 30 can be suppressed from being deformed, thereby preventing the ink cartridge 30 in the attached state from shifting from its position or changing its orientation in the cartridge-attachment portion 110.

In the present embodiment, in the attached state, the position of the ink cartridge 30 in the front-rear direction 8 relative to the cartridge-attachment portion 110 is fixed through contact between the contact surface 49 of the partition wall 48 and the distal end of the ink supply tube 102, without increasing the urging force applied by the coil spring 115.

In the present embodiment, in the attached state, the contact surface 49 of the partition wall 48 contacts both the protrusion 117 of the connector 107 and the distal end of the ink supply tube 102, that is, the protrusion 117 and the distal end of the ink supply tube 102 contact the same surface (i.e., the contact surface 49). In other words, the surface (i.e., the contact surface 49) contacting the protrusion 117 and the surface (i.e., the contact surface 49) contacting the distal end of the ink supply tube 102 are one and the same surface. Accordingly, the structure of the housing 31 constituting the ink cartridge 30 is simplified. However, the surface contacting the protrusion 117 and the surface contacting the distal end of the ink supply tube 102 need not necessarily be the same surface.

In the present embodiment, the sealing member 76 is elastically deformable between: the open shape in which the slit 78 is opened to allow the ink supply tube 102 to be inserted into the slit 78; and the closed shape in which the slit 78 is closed. Accordingly, ink is unlikely to leak out through the slit 78 while the ink cartridge 30 is removed from the cartridge-attachment portion 110. Further, since the slit 78 extends along the horizontal direction (the left-right direction 9), ink is unlikely to leak out through the slit 78 while the ink supply tube 102 is inserted into the slit 78 and extends through the elastically deformed sealing member 76. Further, during the pivotal movement of the ink cartridge 30 about the point of contact between the ink supply tube 102 and the inner surface of the sealing member 76 defining the slit 78, the inner surfaces of the sealing member 76 are is in pressure contact with the top and bottom of the ink supply tube 102, thereby restricting the ink cartridge 30 from shifting in position in the up-down direction 7. Hence, this configuration stabilizes the contact between the locking surface 62 and the locking part 129, ensuring that the ink cartridge 30 is reliably locked in its attached state to the cartridge case 101.

By providing the film 77 to seal the opening formed in the ink supply cylinder 34 (i.e., the open end of the communication chamber 35), the opening of the ink supply cylinder 34 (i.e., the open end of the communication chamber 35) is reliably sealed until the film 77 is peeled off or punctured.

[Modifications]

While the description has been made in detail with reference to the specific embodiment, it would be apparent to those skilled in the art that many modifications and variations may be made thereto. In the following description, of the components and elements in each modification, the components and elements that are identical to those of the above-described embodiment are designated with the same reference numerals to avoid duplicating descriptions, and only the components and elements that differ from those of the above-described embodiment will be described.

[First Modification]

Figure 9:
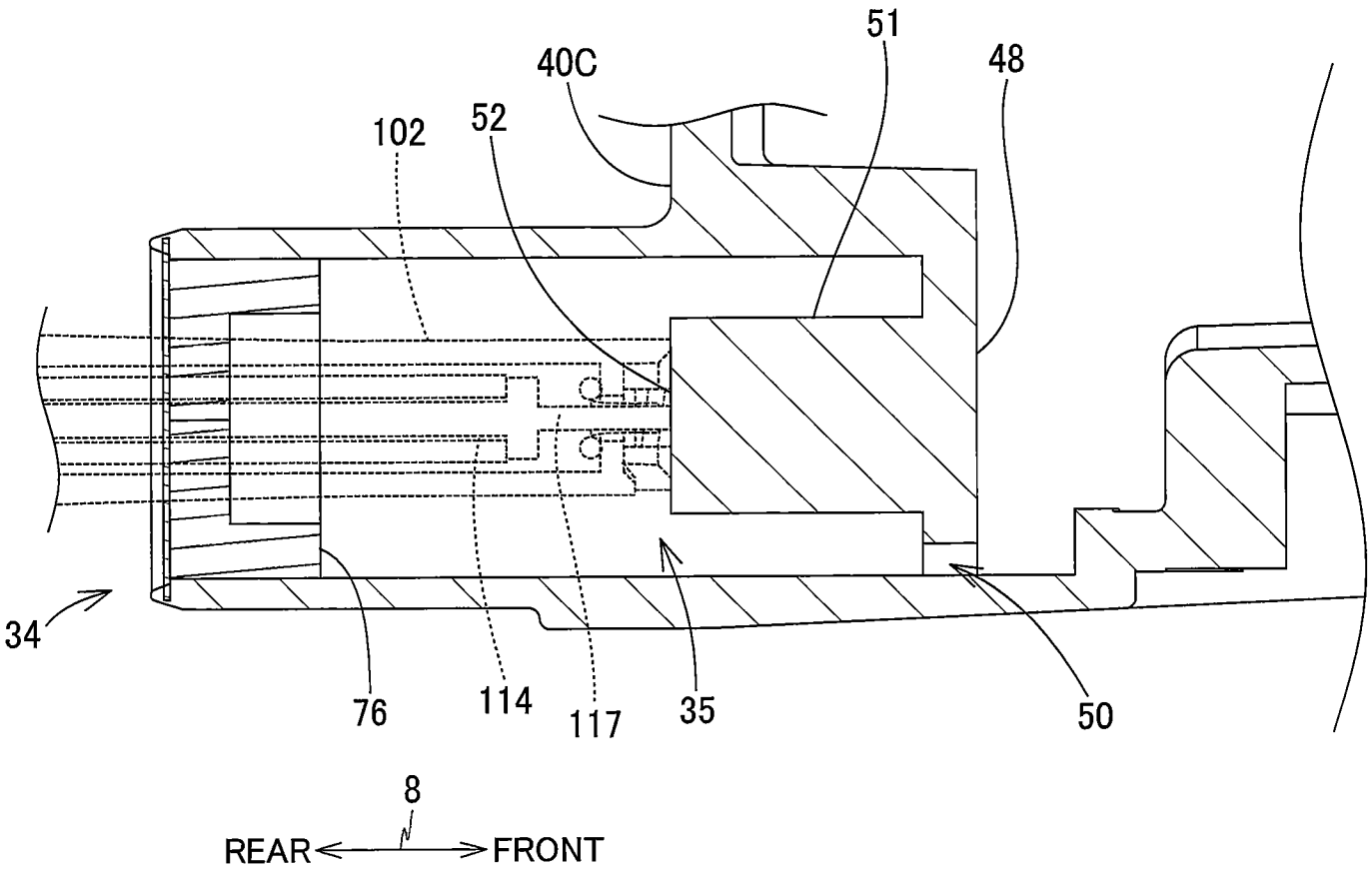
FIG. 9 is an elongated vertical cross-sectional view illustrating a vicinity of a communication chamber of an ink cartridge according to a first modification of the embodiment in an attached state.

First, a first modification of the present embodiment will be described while referring to FIG. 9. In the ink cartridge 30 according to the embodiment described above, the partition wall 48 has the contact surface 49 that faces the communication chamber 35, but the shape of the partition wall 48 may be modified. As illustrated in FIG. 9, in the first modification, a cartridge-side protrusion 51 is provided on the partition wall 48.

The cartridge-side protrusion 51 has a columnar shape and is immovable relative to the sealing member 76. The cartridge-side protrusion 51 protrudes from the partition wall 48 toward the sealing member 76 (i.e., in the rearward direction) within the communication chamber 35. In other words, the cartridge-side protrusion 51 protrudes from the partition wall 48 toward the open end of the communication chamber 35 within the communication chamber 35. The cartridge-side protrusion 51 has a protruding end surface 52 (the rear end surface) facing the sealing member 76 in the front-rear direction 8. The protruding end surface 52 is spaced away from the sealing member 76 in the front-rear direction 8. The protruding end surface 52 is positioned closer to the storage chamber 32 in the front-rear direction 8 than the sealing member 76 is to the storage chamber 32 in the front-rear direction 8. The cartridge-side protrusion 51 is an example of the protrusion of the liquid cartridge of the present disclosure.

As shown in FIG. 9, in the attached state, the protruding end surface 52 is in contact with both the protrusion 117 of the connector 107 and the distal end of the ink supply tube 102. Further, similarly to the contact surface 49 of the above-described embodiment, in the process of attaching the ink cartridge 30 to the cartridge-attachment portion 110, the protruding end surface 52 contacts the ink supply tube 102 after contacting the protrusion 117. In this way, the protruding end surface 52 performs the same function as the contact surface 49 of the above-described embodiment. Hence, this construction can obtain the same effects described above in the embodiment. Further, this configuration allows the position of the partition wall 48 to be set differently from the position of the protruding end surface 52 in the front-rear direction 8. The protruding end surface 52 is an example of the surface of the present disclosure.

[Second Variation]

Figure 10A:
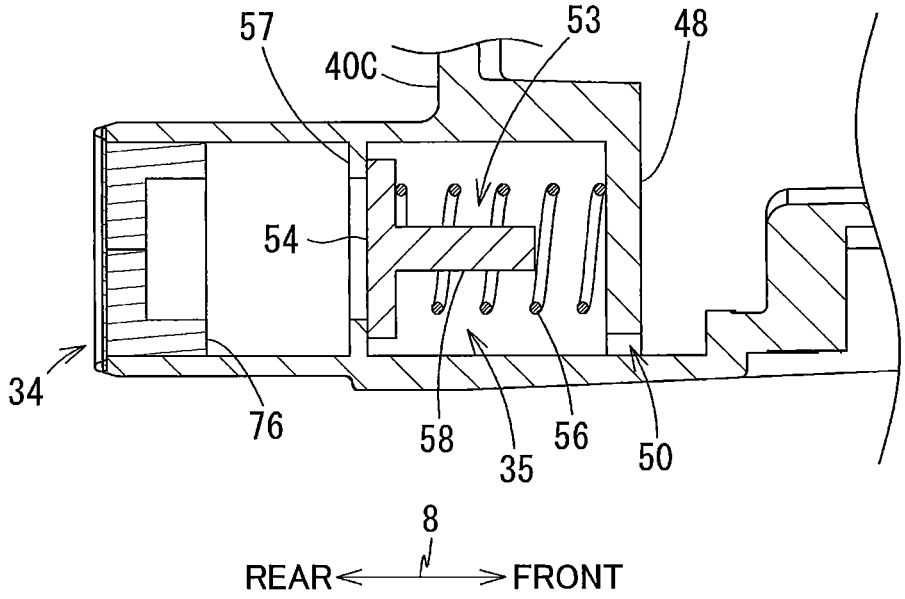
FIG. 10A is an elongated vertical cross-sectional view illustrating a vicinity of a communication chamber of an ink cartridge according to a second modification of the embodiment, the view illustrating a state in which a movable member of the ink cartridge according to the second modification is in a first position.
Figure 10B:
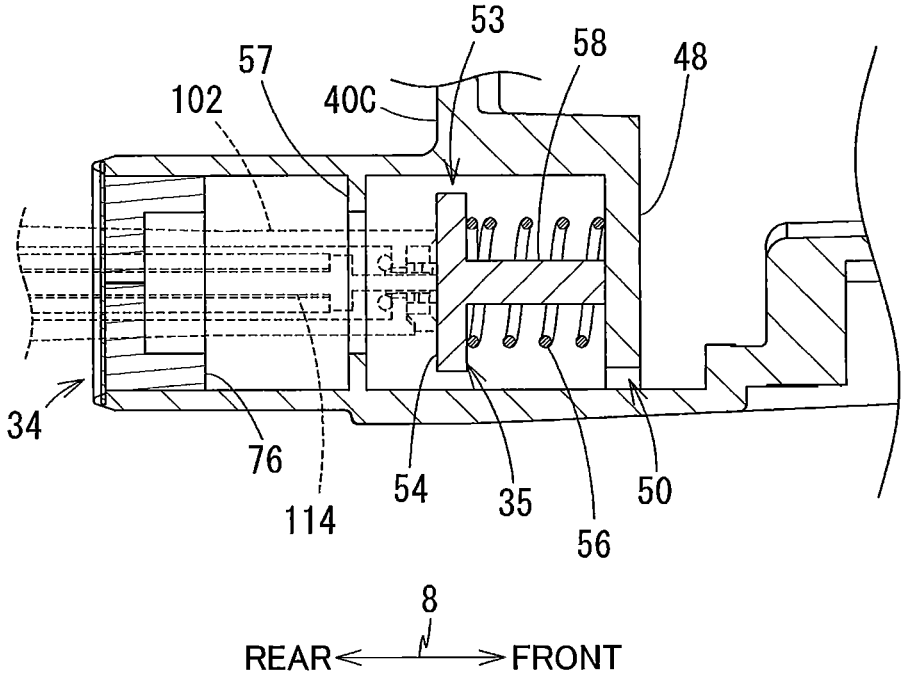
FIG. 10B is an elongated vertical cross-sectional view illustrating the vicinity of the communication chamber of the ink cartridge according to the second modification of the embodiment in an attached state, the view illustrating a state in which the movable member of the ink cartridge according to the second modification is in a second position.

Next, a second modification of the present embodiment will be described while referring to FIGS. 10A and 10B. The surface contacting both the protrusion 117 of the connector 107 and the distal end of the ink supply tube 102 may be defined on another member independent of the partition wall 48. FIGS. 10A and 10B illustrate the second modification in which a movable member 53 and a coil spring 56 are provided in the communication chamber 35 between the partition wall 48 and the sealing member 76 in the front-rear direction 8.

The movable member 53 is movable between a first position shown in FIG. 10A and a second position shown in FIG. 10B within the communication chamber 35. The first position and the second position are spaced away from the sealing member 76 in the front-rear direction 8. The first position is closer to the sealing member 76 in the front-rear direction 8 than the second position to the sealing member 76 in the front-rear direction 8. In other words, the first position is closer to the open end of the communication chamber 35 in the front-rear direction 8 than the second position to the open end of the communication chamber 35 in the front-rear direction 8.

The communication chamber 35 has a projection 57 that protrudes inward from the inner surface of the communication chamber 35. The projection 57 prevents the movable member 53 from moving toward the sealing member 76 (i.e., in the rearward direction) from the first position. The movable member 53 has a protrusion 58 that protrudes toward the partition wall 48. Through contact between the protrusion 58 and partition wall 48, the movable member 53 is prevented from moving toward the partition wall 48 (i.e., in the frontward direction) from the second position. Note that the projection 57 that contacts the movable member 53 may be eliminated. In this case, the movable member 53 and coil spring 56 may be configured such that the movable member 53 is in a position not in contact with the sealing member 76 when the coil spring 56 is at its natural length, for example.

The coil spring 56 is disposed between the partition wall 48 and the movable member 53. The coil spring 56 urges the movable member 53 toward the first position. With this construction, the movable member 53 remains in the first position unless an external force is applied to the movable member 53. The coil spring 56 is an example of the urging member of the present disclosure.

The movable member 53 has an outer surface 54 that faces the sealing member 76, i.e., in the rearward direction. The outer surface 54 is spaced away from the sealing member 76 in the front-rear direction 8. The outer surface 54 is positioned closer to the storage chamber 32 in the front-rear direction 8 than the sealing member 76 is to the storage chamber in the front-rear direction 8.

As illustrated in FIG. 10B, in the attached state, the outer surface 54 is in contact with both the protrusion 117 of the connector 107 and the distal end of the ink supply tube 102 and the movable member 53 is in its second position. Further, similarly to the contact surface 49 of the above-described embodiment, in the process of attaching the ink cartridge 30 to the cartridge-attachment portion 110, the outer surface 54 contacts the ink supply tube 102 after contacting the protrusion 117. In this way, the outer surface 54 performs the same function as the contact surface 49 of the above-described embodiment. Hence, this construction can obtain the same effects described above in the embodiment. The outer surface 54 is an example of the surface of the present disclosure.

In the second modification, when the ink cartridge 30 is retained in the cartridge-attachment portion 110 such that the valve 114 of the ink supply tube 102 is in the open position (i.e., when the ink cartridge 30 is in its attached state), the urging force of the coil spring 56 is applied to the partition wall 48 in the frontward direction (i.e., in the direction for moving the ink cartridge 30 out of the cartridge-attachment portion 110). Further, since the movable member 53 in the first position is spaced away from the sealing member 76 along the front-rear direction 8 and the coil spring 56 is not a spring for preventing ink stored in the communication chamber 35 from leaking out, water tightness is not required between the sealing member 76 and the movable member 53.

With the above configuration, in comparison with a configuration in which there is employed a spring that produces a large urging force for increasing water tightness, a small load is applied to the ink cartridge 30 while the ink cartridge 30 is in the attached state to the cartridge-attachment portion 110. Accordingly, the ink cartridge 30 can be extracted easily from the cartridge-attachment portion 110. Further, in the second modification, the communication chamber 35 provides a space defined between the outer surface 54 of the movable member 53 and the sealing member 76. Hence, any ink that leaks from a gap between the movable member 53 and projection 57 can be stored in this space, thereby preventing ink from leaking out of the ink cartridge 30.

[Third Modification]

Figure 14:
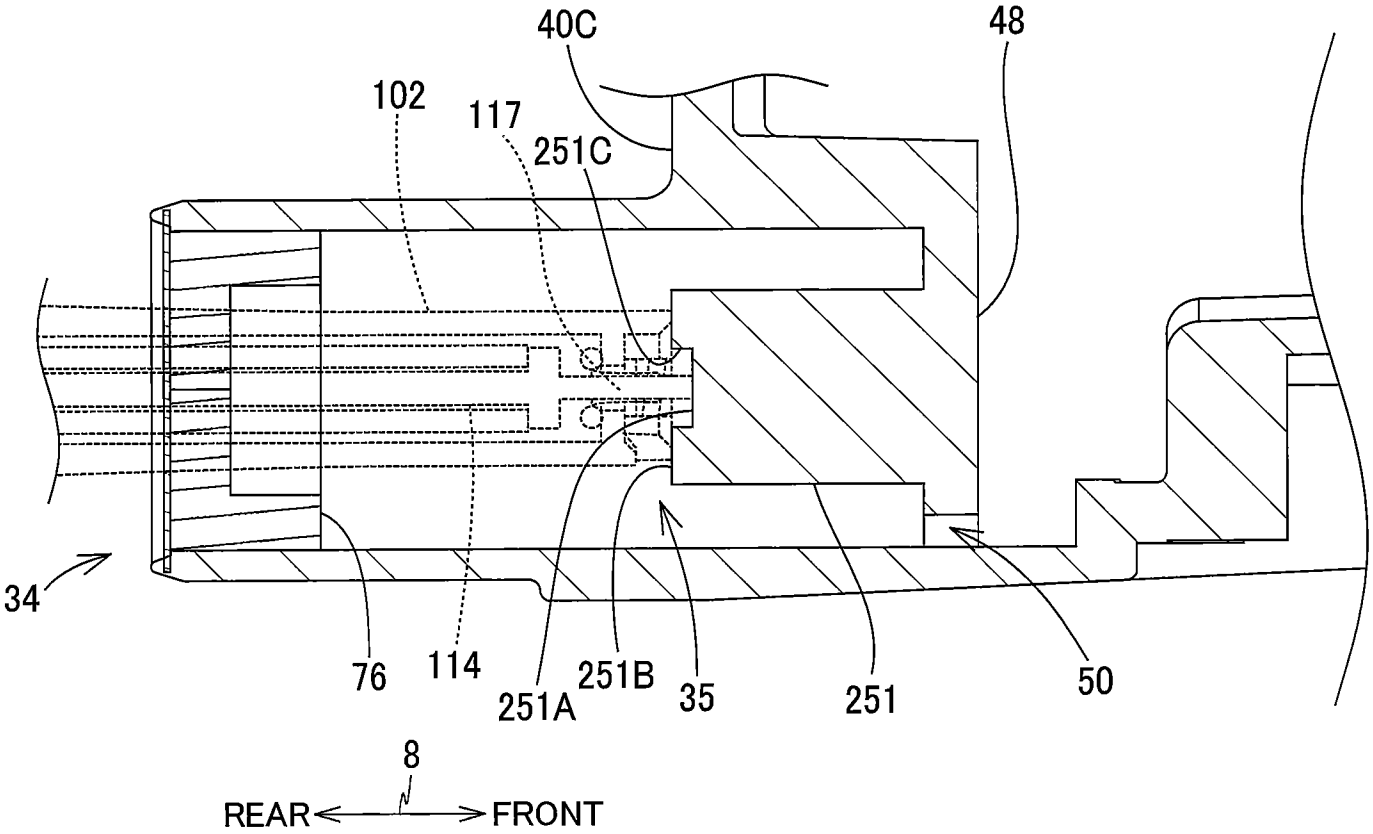
FIG. 14 is an elongated vertical cross-sectional view illustrating a vicinity of a communication chamber of an ink cartridge according to a third modification of the embodiment in an attached state.

Next, a third modification of the present embodiment will be described while referring to FIG. 14. In the ink cartridge 30 according to the embodiment described above, the partition wall 48 has the contact surface 49 that faces the communication chamber 35, but the shape of the partition wall 48 may be modified. As illustrated in FIG. 14, in the third modification, a cartridge-side protrusion 251 is provided on the partition wall 48.

The cartridge-side protrusion 251 has a substantially columnar shape and is immovable relative to the sealing member 76. The cartridge-side protrusion 251 protrudes from the partition wall 48 toward the sealing member 76 (i.e., in the rearward direction) within the communication chamber 35. In other words, the cartridge-side protrusion 251 protrudes from the partition wall 48 toward the open end of the communication chamber 35 within the communication chamber 35.

The cartridge-side protrusion 251 has a protruding end portion (a rear end potion) formed with a recess recessed in the frontward direction. The recess is formed at the diametrical center portion of the protruding end portion.

The protruding end portion of the cartridge-side protrusion 251 has a first surface 251A, a second surface 251B, and a connecting surface 251C that connects the first surface 251A and the second surface 251B.

The first surface 251A extends in the up-down direction 7 and left-right direction 9 and has a circular shape as viewed from the rear. The first surface 251A faces the sealing member 76 and the open end of the communication chamber 35 in the front-rear direction 8. The first surface 251A is spaced away from the sealing member 76 in the front-rear direction 8. The first surface 251A is positioned closer to the storage chamber 32 in the front-rear direction 8 than the sealing member 76 is to the storage chamber 32 in the front-rear direction 8.

The second surface 251B extends in the up-down direction 7 and left-right direction 9 and has an annular shape surrounding the first surface 251A as viewed from the rear. The second surface 251B faces the sealing member 76 and the open end of the communication chamber 35 in the front-rear direction 8. The second surface 251B is spaced away from the sealing member 76 in the front-rear direction 8. The second surface 251B is positioned closer to the storage chamber 32 in the front-rear direction 8 than the sealing member 76 is to the storage chamber 32 in the front-rear direction 8.

The connecting surface 251C connects the outer peripheral edge of the first surface 251A and the inner peripheral edge of the second surface 251B. The connecting surface 251C and the first surface 251A define the above-described recess in cooperation with each other.

The position in the front-rear direction 8 of the first surface 251A is different from that of the first surface 251B. In the third modification, the second surface 251B is positioned closer to the sealing member 76 in the front-rear direction 8 than the first surface 251A is to the sealing member 76 in the front-rear direction 8. However, the positions of the first surface 251A and the second surface 251B are not limited to the configuration of the third modification. The first surface 251A may be positioned closer to the sealing member 76 in the front-rear direction 8 than the second surface 251B is to the sealing member 76 in the front-rear direction 8.

In the third modification, in the process of attaching the ink cartridge 30 to the cartridge-attachment portion 110, the first surface 251A contacts the protrusion 117 and then the second surface 251B contacts the distal end of the ink supply tube 102. Further, as shown in FIG. 14, in the attached state, the first surface 251A is in contact with the protrusion 117 of the connector 107 and the second surface 251B is in contact with the distal end of the ink supply tube 102. Hence, this construction can obtain the same effects described above in the embodiment. Further, this configuration allows the surface contacting the protrusion 117 to be provided differently from the surface contacting the distal end of the ink supply tube 102.

[Other Modification]

In the embodiment described above, the ink cartridge 30 is pivotally movable in the cartridge-attachment portion 110 between the locking position and the releasing position, and the ink cartridge 30 is retained in the cartridge-attachment portion 110 against the urging force of the coil spring 115 through contact between the locking part 129 and the locking surface 62 on the protruding part 43 of the ink cartridge 30. However, the configuration for retaining the ink cartridge 30 in the cartridge-attachment portion 110 is not limited to this embodiment. For example, the top surface of the protruding part 43 constituting part of the ink cartridge 30 may be configured to contact the inner surface of the cartridge case 101 constituting the cartridge-attachment portion 110, and the ink cartridge 30 may be retained in the cartridge-attachment portion 110 against the urging force of the coil spring 115 through sliding friction generated by the contact between the top surface of the protruding part 43 and the inner surface of the cartridge case 101.

The ink cartridge 30 may also be formed in a rectangular parallelepiped shape. In this case, the locking surface 62 may be eliminated, for example. Further, the rear wall 40 of the ink cartridge 30 may be formed as a single surface rather than a plurality of surfaces.

What is claimed is:

1. A liquid cartridge attachable to an attachment portion, the attachment portion including:
- a holder providing an accommodation space for accommodating therein the liquid cartridge in an attached state;
- a tube formed with an opening opening toward the accommodation space;
- a valve movable between an open position opening the opening and a closed position closing the opening;
- a protrusion protruding from the valve toward the accommodation space, the protrusion protruding into the accommodation space through the opening in the closed position of the valve; and
- a spring urging the valve toward the closed position, the liquid cartridge comprising:
- a liquid chamber for storing therein liquid;
- a communication passage for communicating the liquid chamber with an outside of the liquid cartridge, the communication passage extending from the liquid chamber in a first direction to have an open end in the first direction;
- a sealing member fitted to the communication passage; and
- a surface facing the sealing member in the first direction, the surface being spaced away from the sealing member in the first direction, the surface being positioned closer to the liquid chamber in the first direction than the sealing member is to the liquid chamber in the first direction, wherein, in the attached state,
- the tube extends through the open end and the sealing member,
- the opening is positioned in the communication passage, and
- the surface is in contact with both the protrusion and the tube.

2. The liquid cartridge according to claim 1, further comprising a protrusion protruding toward the open end within the communication passage, the protrusion of the liquid cartridge being immovable relative to the sealing member, the protrusion of the liquid cartridge having a protruding end surface facing the sealing member in the first direction,
- wherein the protruding end surface constitutes the surface.

3. The liquid cartridge according to claim 1, further comprising:
- a movable member movable between a first position and a second position within the communication passage, the first position and the second position being spaced away from the sealing member in the first direction, the first position being closer to the open end in the first direction than the second position is to the open end in the first direction, the movable member having an outer surface facing the sealing member; and
- an urging member urging the movable member toward the first position,
- wherein the outer surface constitutes the surface.

4. The liquid cartridge according to claim 1, wherein the sealing member is formed with a slit, the sealing member being elastically deformable between an open shape opening the slit and a closed shape closing the slit,
- wherein the tube is insertable into the communication passage through the slit.

5. The liquid cartridge according to claim 4, wherein, in the attached state, the slit extends in a direction crossing a gravitational direction.

6. The liquid cartridge according to claim 1, further comprising a film sealing the open end.

7. The liquid cartridge according to claim 1, further comprising:
- a first wall;
- a second wall, the first wall and the second wall being spaced away from each other in the first direction with the liquid chamber interposed between the first wall and the second wall, the first wall defining at least a portion of the communication passage, the first wall being positioned further in the first direction relative to the second wall;
- a third wall; and
- a fourth wall, the third wall and the fourth wall connecting the first wall and the second wall, the third wall and the fourth wall being spaced away from each other in a direction orthogonal to the first direction with the liquid chamber interposed between the third wall and the fourth wall.

8. The liquid cartridge according to claim 7, further comprising a circuit board positioned at the second wall.

9. The liquid cartridge according to claim 1, wherein the first direction is orthogonal to a gravitational direction.

10. The liquid cartridge according to claim 1, wherein the attachment portion further comprises a locking part capable of contacting the liquid cartridge accommodated in the accommodation space, wherein the liquid cartridge is maintained in the attached state by the locking part contacting the liquid cartridge, and wherein, in the attached state, the surface is in contact with the protrusion to maintain the valve at the open position against an urging force of the spring.

11. The liquid cartridge according to claim 10, wherein the locking part has a locking surface, and wherein, in a state in which the tube extends through the sealing member, the liquid cartridge is pivotally movable between:

a facing position in which a portion of the liquid cartridge faces the locking surface in an insertion direction in which the liquid cartridge is inserted into the accommodation space; and a non-facing position in which the portion of the liquid cartridge does not face the locking surface in the insertion direction.

12. The liquid cartridge according to claim 1, wherein, in a process from start of insertion of the liquid cartridge into the accommodation space to completion of attachment of the liquid cartridge to the attachment portion, the protrusion contacts surface and then the tube contacts the surface.

13. A liquid cartridge attachable to an attachment portion, the attachment portion including:

a holder providing an accommodation space for accommodating therein the liquid cartridge in an attached state;

a tube formed with an opening opening toward the accommodation space;

a valve movable between an open position opening the opening and a closed position closing the opening;

a protrusion protruding from the valve toward the accommodation space, the protrusion protruding into the accommodation space through the opening in the closed position of the valve; and a spring urging the valve toward the closed position, the liquid cartridge comprising:

a liquid chamber for storing therein liquid;

a communication passage for communicating the liquid chamber with an outside of the liquid cartridge, the communication passage extending from the liquid chamber in a first direction to have an open end in the first direction;

a sealing member fitted to the communication passage;

a first surface facing the sealing member in the first direction, the first surface being spaced away from the sealing member in the first direction, the first surface being positioned closer to the liquid chamber in the first direction than the sealing member is to the liquid chamber in the first direction; and a second surface facing the sealing member in the first direction, the second surface being spaced away from the sealing member in the first direction, the second surface being positioned closer to the liquid chamber in the first direction than the sealing member is to the liquid chamber in the first direction, wherein, in the attached state, the tube extends through the open end and the sealing member, the opening is positioned in the communication passage, the first surface is in contact with the protrusion, and the second surface is in contact with the tube.

14. A system comprising:

an attachment portion; and a liquid cartridge attachable to the attachment portion, the attachment portion comprising:

a holder providing an accommodation space for accommodating therein the liquid cartridge in an attached state;

a tube formed with an opening opening toward the accommodation space;

a valve movable between an open position opening the opening and a closed position closing the opening;

a protrusion protruding from the valve toward the accommodation space, the protrusion protruding into the accommodation space through the opening in the closed position of the valve; and a spring urging the valve toward the closed position, the liquid cartridge comprising:

a liquid chamber for storing therein liquid;

a communication passage for communicating the liquid chamber with an outside of the liquid cartridge, the communication passage extending from the liquid chamber in a first direction to have an open end in the first direction;

a sealing member fitted to the communication passage; and a surface facing the sealing member in the first direction, the surface being spaced away from the sealing member in the first direction, the surface being positioned closer to the liquid chamber in the first direction than the sealing member is to the liquid chamber in the first direction, wherein, in the attached state, the tube extends through the open end and the sealing member, the opening is positioned in the communication passage, and the surface is in contact with both the protrusion and the tube.

* * * * *